US005435767A

United States Patent [19]

Miyake et al.

[11] Patent Number: 5,435,767

[45] Date of Patent: Jul. 25, 1995

[54] APPARATUS FOR MANUFACTURING CATHODE-RAY TUBES

[75] Inventors: Minoru Miyake, Kanagawa; Koichi Yamamoto, Tokyo, both of Japan

[73] Assignee: Sony Corporation, Tokyo, Japan

[21] Appl. No.: 224,571

[22] Filed: Apr. 7, 1994

[30] Foreign Application Priority Data

Apr. 7, 1993 [JP] Japan ..... 5-080755

[51] Int. Cl.[6] ..... H01J 9/40; H01J 9/42

[52] U.S. Cl. ..... 445/63; 445/70; 445/73

[58] Field of Search ..... 445/70, 73, 63, 3

[56] References Cited

U.S. PATENT DOCUMENTS 2,162,209 6/1939 Trutner ..... 445/70
4,157,206 6/1979 Ikeda ..... 445/63
5,178,572 1/1993 Choi ..... 445/70

FOREIGN PATENT DOCUMENTS 55-74039 6/1980 Japan ..... 445/63

*Primary Examiner*—Mark Rosenbaum
*Assistant Examiner*—Jeffrey T. Knapp
*Attorney, Agent, or Firm*—Hill, Steadman & Simpson

[57] ABSTRACT

A plurality of successive evacuating carts for carrying respective cathode-ray tube bulbs thereon are circulatingly fed along a looped feed path into and out of an evacuating furnace. While in the evacuating furnace, the cathode-ray tube bulb carried on each of the evacuating carts is evacuated, and the evacuating pipe thereof is sealed. An evacuating pipe detecting device is disposed at a position along the feed path for detecting whether the evacuating pipe of the cathode-ray tube bulb carried on each of the evacuating units is damaged or not. If the evacuating pipe of any cathode-ray tube bulb is detected as being damaged and remains on the evacuating cart, the evacuating cart is discharged out of the feed path, and a replacement evacuating cart is charged into the feed path.

9 Claims, 35 Drawing Sheets

Cathode-Ray Tube Bulv

Photoelectric Sensor Unit

Detected Signal From Sensor ( Locked ) ( Released )

APPARATUS FOR MANUFACTURING CATHODE-RAY TUBES

BACKGROUND OF THE INVENTION

1. Field of the Invention

The present invention relates to an apparatus for manufacturing cathode-ray tubes, and more particularly to a cathode-ray tube manufacturing apparatus capable of automatically evacuating and sealing a cathode-ray tube bulb after electron guns have been sealingly installed in the neck of the cathode-ray tube bulb.

2. Description of the Related Art

In the manufacture of cathode-ray tubes such as color cathode-ray tubes, for example, as shown in FIG. 1 of the accompanying drawings, electron guns 3 are inserted in a neck 2 of a cathode-ray tube bulb 1, and a glass stem 6 integral with an evacuating pipe (tipoff pipe) 4 and from which step pins 5 are extended is sealingly mounted in the end of the neck 2. Thereafter, the cathode-ray tube bulb 1 is delivered to an evacuating and sealing process in which it is evacuated and the evacuating pipe 4 is melted and sealed.

In the evacuating and sealing process, the cathode-ray tube bulb 1 which has been fed from the electron gun sealing process by a bulb conveyor is transferred onto an evacuating device, which will hereinafter be referred to as an evacuating cart, on evacuating furnace rails by an automatic transfer mechanism.

The evacuating cart is equipped with an evacuating port for connecting the evacuating pipe 4 to an evacuating pump and a sealing jig for melting with heat and sealing the evacuating pipe 4 after the cathode-ray tube bulb 1 has been evacuated.

The cathode-ray tube bulb 1 is set on the evacuating cart such that the evacuating pipe 4 is inserted through the sealing jig into the evacuating port. The cathode-ray tube bulb 1 is carried on the evacuating cart along the evacuating furnace rails into an evacuating furnace. In the evacuating furnace, the cathode-ray tube bulb 1 is heated to a predetermined temperature and evacuated, and thereafter the evacuating pipe 4 is sealed.

When the above process is finished, the evacuating cart is delivered out of the evacuating furnace, and the evacuating port and the sealing jig are removed from the evacuating cart. The cathode-ray tube bulb 1 is dismounted from the evacuating cart by the automatic transfer mechanism, and then conveyed to a next process. The evacuating cart is circulated into the evacuating furnace with another cathode-ray tube bulb mounted thereon.

In the art of manufacturing cathode-ray tubes, it has been desired to fully automatically evacuating and sealing cathode-ray tube bulbs.

However, there are actually instances wherein cathode-ray tube bulbs cannot be charged onto all evacuating carts in the sequence described above. Since it is necessary to subject all the evacuating carts to vacuum aging in the evacuating furnace, i.e., to keep the evacuating pump of each evacuating cart always in an operative condition even if no cathode-ray tube bulb is charged onto the evacuating cart, the worker inserts a dummy evacuating pipe into the evacuating port of any evacuating cart that is charged with no cathode-ray tube bulb. Since the evacuating carts are stopped in somewhat different positions, it is difficult to automatically insert and remove dummy pipes, and hence the worker is relied upon for inserting and removing dummy evacuating pipes.

Fully automatic execution of the evacuating and sealing process requires that dummy evacuating pipes be automatically inserted into and removed from corresponding evacuating ports.

After a cathode-ray tube bulb has been sealed, the evacuating port and the sealing jig are removed by the worker. If the evacuating pipe is broken and left in the evacuating port, it is the current practice for the worker to remove the broken evacuating pipe. Consequently, in order that the evacuating and sealing process can be fully automated, it is necessary to automatically detect whether the evacuating pipe is broken or not after the cathode-ray tube bulb has been evacuated and sealed.

In the evacuating and sealing process, the state of an evacuating cart is varied several times in the evacuating furnace by limit switches that are mounted on the evacuating cart. Heretofore, the limit switches on the evacuating cart have been operated by rod-shaped switch changers. In the event that a switch changer interferes with a rotating or fixed portion of the limit switch, it has been customary for the worker to take care of such an accident.

Fully automatic execution of the evacuating and sealing process also requires that such an accident be detected early.

Even if cathode-ray tube bulbs charged onto respective evacuating carts are processed in the predetermined processing sequence, not all the cathode-ray tube bulbs can necessarily be discharged as good or acceptable products from the evacuating and sealing process. One of the reasons for the problem is a failure of the sealing jig.

One conventional device for detecting a sealing jig failure is incorporated in a sealing device, and capable of detecting both a wire break and a full short circuit. However, it has not been customary to detect a short circuit across one turn or the like of the coil heater of the sealing jig because any change in the coil resistance due to such a short circuit is very small. Even when the coil heater of a sealing jig suffers such a short circuit, therefore, it has been the practice to keep the cathode-ray tube bulb processed. With such a coil heater short circuit, the evacuating pipe is sealed at a voltage different from a predetermined voltage pattern owing to a resistance change caused by the short circuit, resulting in a poor sealing condition of the evacuating pipe. It has thus been necessary for the worker to visually check sealed evacuating pipes for a sealing failure.

If any coil heater short circuit occurs across only one turn or the like, the sealed condition of the evacuating pipe differs only slightly from the normally sealed condition. Consequently, since sealed cathode-ray tube bulbs are checked by the worker, it has been difficult to uniquely determine whether the cathode-ray tube bulbs have been sealed properly or not.

When a possibility of failure of any of the sealing jigs is recognized, it has been customary for the worker to measure the resistance of the sealing jig with a resistance measuring instrument or the like to determine whether it actually suffers a failure or not.

Other requirements for complete automatization of the evacuating and sealing process are early automatic detection of a sealing failure of evacuating pipes and a reduction in the burden on the worker in confirming the sealed condition of evacuating pipes.

OBJECTS AND SUMMARY OF THE INVENTION

It is therefore an object of the present invention to provide an apparatus for manufacturing cathode-ray tubes which is capable of fully automatizing an evacuating and sealing process.

According to the present invention, there is provided an apparatus for manufacturing a cathode-ray tube by evacuating a cathode-ray tube bulb and sealing an evacuating pipe of the cathode-ray tube bulb, comprising an evacuating furnace, a plurality of evacuating units for carrying respective cathode-ray tube bulbs thereon, and evacuating and sealing the respective cathode-ray tube bulbs, means for feeding the evacuating units circulatingly along a feed path into and out of the evacuating furnace, and an evacuating pipe detecting device disposed at a position along the feed path for detecting whether the evacuating pipe of the cathode-ray tube bulb carried on each of the evacuating units is damaged or not.

The evacuating pipe detecting device may comprise photoelectric sensor means having a light-emitting element and a light-detecting element which are disposed in spaced confronting relationship to each other, and control means for reciprocally moving the photoelectric sensor means so as to allow the evacuating pipe of the cathode-ray tube carried on each of the evacuating units to pass between the light-emitting element and the light-detecting element. The control means comprises means for moving the photoelectric sensor means toward the evacuating pipe at a speed higher than a speed at which the photoelectric sensor means moves away from the evacuating pipe.

The apparatus for manufacturing a cathode-ray tube may further comprise means for discharging, out of the feed path, an evacuating unit on which the evacuating pipe is detected as being damaged by the evacuating pipe detecting device and remains.

The apparatus for manufacturing a cathode-ray tube may further comprise dummy evacuating pipe insert-/removing means for inserting a dummy evacuating pipe into and removing a dummy evacuating pipe from an evacuating unit on which a cathode-ray tube bulb is not carried. Each of the evacuating units may have an evacuating port for evacuating the cathode-ray tube bulb carried thereon, the dummy evacuating pipe insert-/removing means may comprise a floating mechanism, a movable base movable by the floating mechanism, a first chuck assembly for holding and transferring a dummy evacuating pipe onto the movable base, and a second chuck assembly for holding a reference member to assure a predetermined positional relationship with respect to an evacuating port of each of the evacuating units.

Each of the evacuating units may have a sealing jig for sealing the evacuating pipe of a cathode-ray tube bulb carried thereon, and the apparatus may further comprise sealing jig detecting means for detecting a failure of the sealing jig of each of the evacuating units. The sealing jig detecting means may comprise a terminal assembly for contacting an external terminal of the sealing jig of each of the evacuating units, a constant-voltage power supply for supplying a constant voltage to the terminal assembly, and an ammeter connected to a current path of the terminal assembly for detecting a current change in the current path depending on a failure of the sealing jig.

Each of the evacuating units may have a switch, and the apparatus may further comprise a switch actuator for actuating the switch of each of the evacuating units, the switch actuator comprising an actuating member for actuating the switch, an air cylinder having a piston rod, and a fixed member, the actuating member having an end angularly movably supported on the fixed member, the actuating member having a side extension angularly movably supported on a distal end of the rod, the arrangement being such that when at least a predetermined force is applied to the actuating member, the actuator member is moved retracting the rod.

The above and other objects, features, and advantages of the present invention will become apparent from the following description of an illustrative embodiment thereof to be read in conjunction with the accompanying drawings, in which like reference numerals represent the same or similar objects.

DETAILED DESCRIPTION OF THE PREFERRED EMBODIMENT

Figure 2:
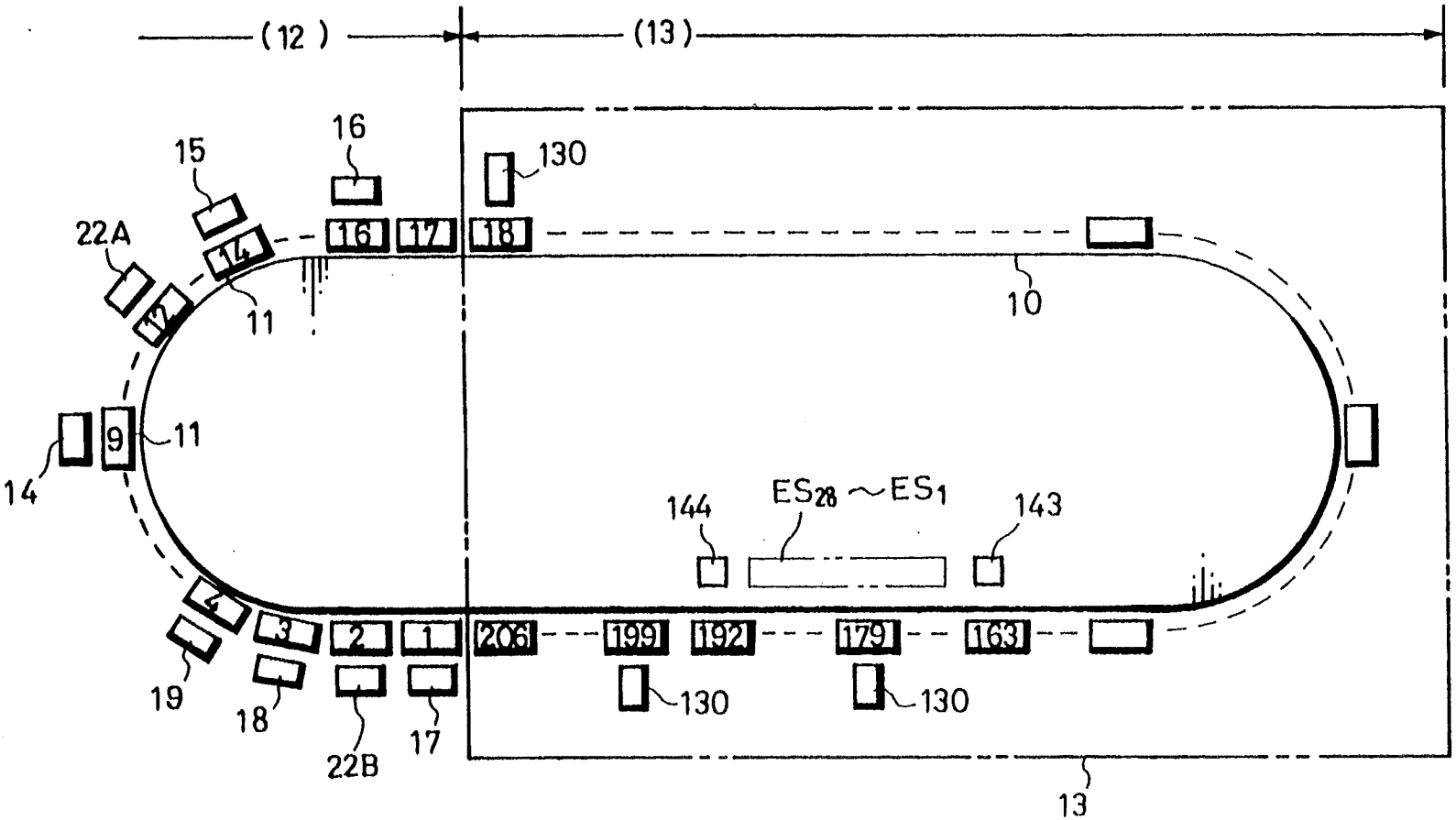
FIG. 2 is a schematic plan view of an apparatus for manufacturing cathode-ray tubes according to the present invention.

FIG. 2 schematically shows an apparatus for manufacturing cathode-ray tubes according to the present invention for use in an evacuating and sealing process. FIGS. 3 through 6 illustrate various portions of the apparatus at enlarged scale.

In FIGS. 2 through 6, the apparatus includes a plurality of evacuating carts 11 which are located in respective successive positions [1]~[206] on endlessly looped evacuating furnace rails 10 which partly extend into an evacuating furnace 12. The evacuating carts 11 are circulatingly movable along the evacuating furnace rails 10 from a region 12 outside of the evacuating furnace 12 into the evacuating furnace 12 and back into the region 12, in an intermittent manner such that each evacuating cart 11 moves cyclically for 15 seconds and then stops for 15 seconds.

Figure 1:
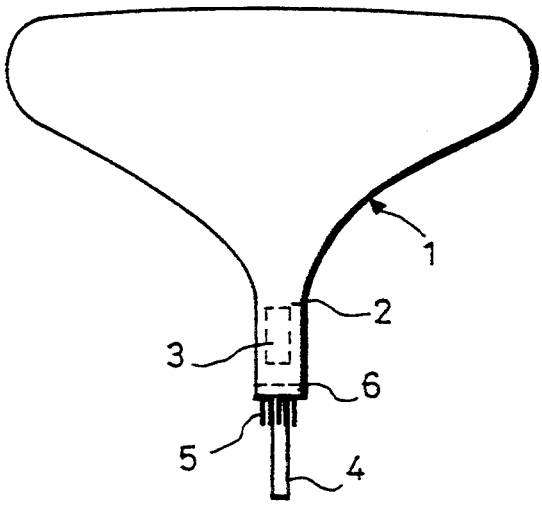
FIG. 1 is a schematic view of a cathode-ray tube bulb.

Various automatic devices are arranged along the evacuating furnace rails 10, i.e., the feed path for feeding the evacuating carts 11 therealong. For example, an automatic cathode-ray tube bulb charging device 14 is located at the position [9] for automatically transferring a cathode-ray tube bulb 1 (see FIG. 1) that has been conveyed from an electron-gun sealing process by a conveyor onto an evacuating cart 11.

A cathode-ray tube bulb centering device 15 is located at the position [14] for automatically positioning or centering a cathode-ray tube bulb 1 that has roughly been placed on the evacuating cart 11 by the automatic cathode-ray tube bulb charging device 14 so that an evacuating pipe 4 of the cathode-ray tube bulb 1 can be inserted into an evacuating port (described later on).

An evacuating port tightening device 16 is located at the position [16] for automatically tightening the port rubber member of an evacuating port to prevent vacuum leakage after the evacuating pipe 4 of a cathode-ray tube bulb 1 has been inserted into the evacuating port.

Sealing power feeding devices $ES_1 \sim ES_{28}$ are located in the respective positions [164]~[191] in the evacuating furnace 13 for supplying a voltage to achieve a predetermined temperature pattern to sealing jigs (described later on) on evacuating carts 11 for sealing the cathode-ray tube bulbs 1 thereon.

Automatic sealing jig detecting devices 143, 144 for automatically detecting whether a sealing jig is good or poor are positioned respectively at the positions [163], [192] on the opposite ends of the array of the sealing power feeding devices $ES_1 \sim ES_{28}$.

An evacuating port loosening device 17 is located at the position [1] just outside and downstream of the evacuating furnace 12 for automatically loosening the port rubber member of an evacuating port in preparation for automatic removal of a cathode-ray tube bulb 1 after the evacuating pipe 4 thereof has been sealed.

An evacuating pipe detecting device 18 is located at the position [3] for confirming whether the evacuating pipe 4 of a cathode-ray tube bulb 1 has been removed from the evacuating port and the sealing jig without being broken.

An automatic cathode-ray tube bulb removing device 19 is located at the position [4] for automatically transferring a cathode-ray tube bulb 1 which has been evacuated and sealed to a conveyor in a next process.

Dummy evacuating pipe inserting/removing devices 22A, 22B are also located along the feed path for the evacuating carts 11 for inserting and removing a dummy evacuating pipe into and from an evacuating port of an evacuating cart 11 in order to be able to keep an evacuating pump operated at all times, i.e., to perform so-called automatic vacuum aging, even if no cathode-ray tube bulb has been transferred onto an evacuating cart 11 at the position [9].

More specifically, the dummy evacuating pipe inserting device 22A is located at a position, e.g., the position [12], downstream of the position [9] wherein a cathode-ray tube bulb 1 is charged, for inserting a dummy evacuating pipe into an evacuating port of an evacuating cart 11 onto which no cathode-ray tube bulb has charged. The dummy evacuating pipe removing device 22B is located at a position, e.g., the position [2], close to the end of the processing cycle, for removing a dummy evacuating pipe from an evacuating port of an evacuating cart 11.

Figure 7:
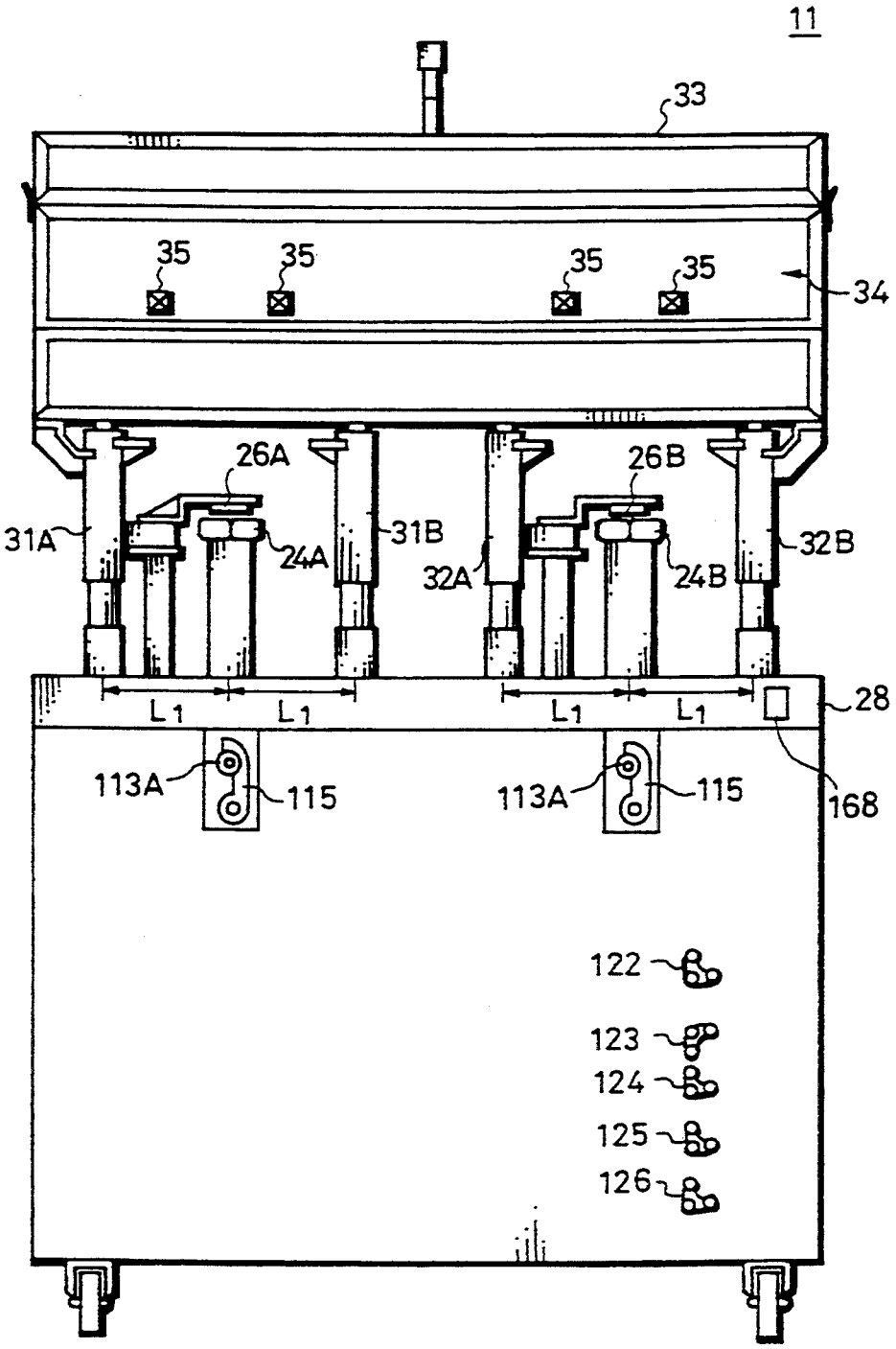
FIG. 7 is a front elevational view of an evacuating cart according to the present invention.
Figure 8:
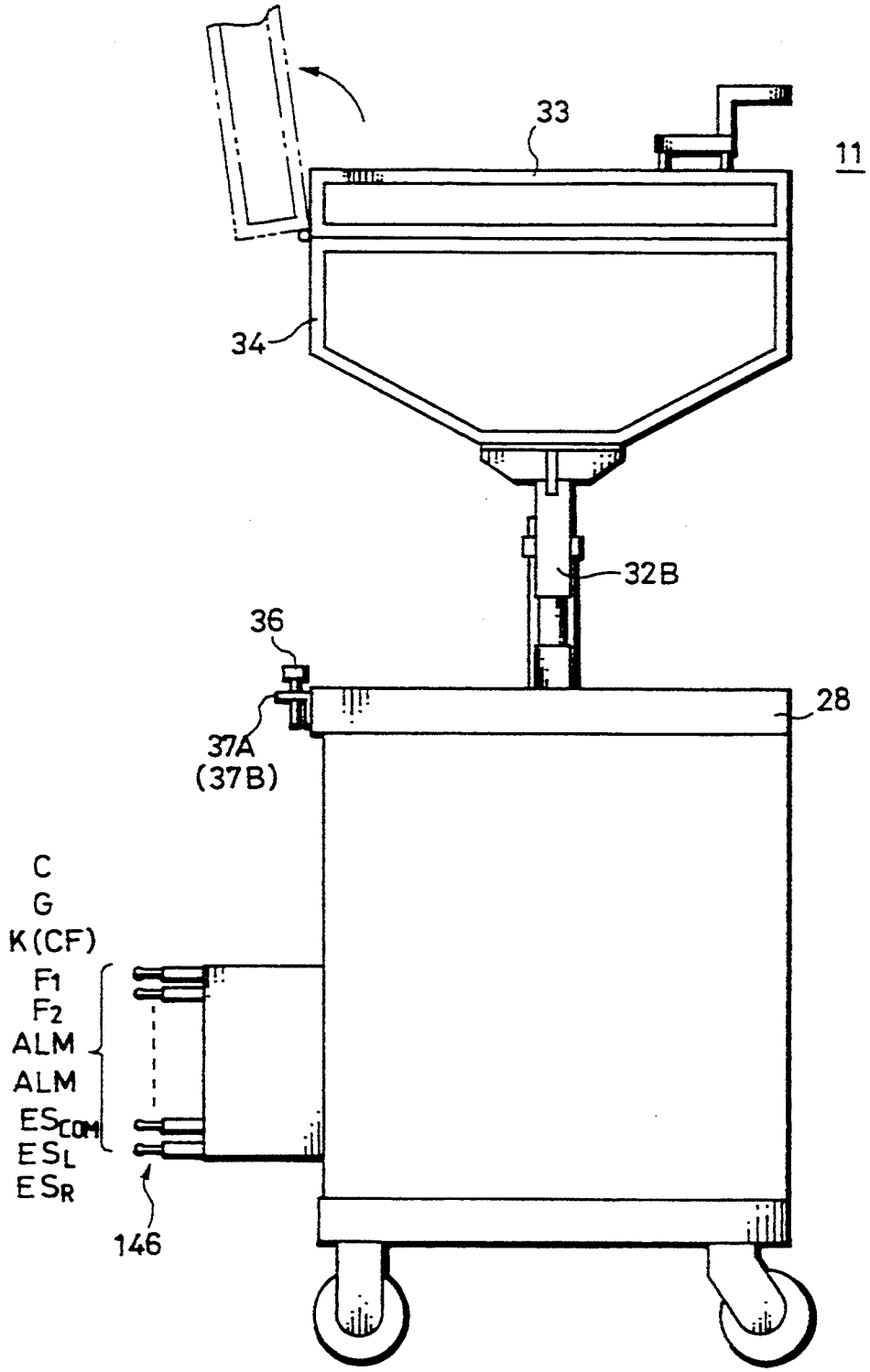
FIG. 8 is a side elevational view of the evacuating cart according to the present invention.

As shown in FIGS. 7 and 8, each of the evacuating carts 11 two evacuating ports 24A, 24B and two sealing jigs 26A, 26B having respective heater coils so that two cathode-ray tube bulbs 1 can be charged simultaneously onto the evacuating cart 11. Each of the evacuating ports 24A, 24B is coupled to an oil dispersion pump and an oil rotation pump (both not shown). The evacuating ports 24A, 24B and the sealing jigs 26A, 26B are mounted on a mount base 28 coaxially with each other. Vertical support columns 31A, 31B and 32A, 32B are also mounted on the mount base 28 on opposite sides of the set of evacuating port 24A and sealing jig 26A and the set of evacuating port 24B and sealing jig 26B. The support columns 31A, 31B and 32A, 32B support thereon an explosion-resistant mesh-like protective cover 34 having an openable/closable lid 33 hinged thereto. The explosion-resistant mesh-like protective cover 34 can house two cathode-ray tube bulbs 1 that are supported by holders 35.

The central axis of each of the support columns 31A, 31B is spaced from the central axis of the evacuating port 24A accurately by a desired distance $L_1$, and the central axis of each of the support columns 32A, 32B is spaced from the central axis of the evacuating port 24B accurately by the same distance $L_1$.

The holders 35 with the cathode-ray tube bulbs 1 supported thereon can vertically be moved by a motor, for example.

Two storage members 37A, 37B are mounted on one end of the mount base 28 of each of the evacuating carts 11 in alignment with the respective evacuating ports 24A, 24B. Respective dummy evacuating pipes 36, each having the same diameter as that of the evacuating pipe 4 (see FIG. 1) are detachably inserted in the storage members 37A, 37B.

Figure 9:
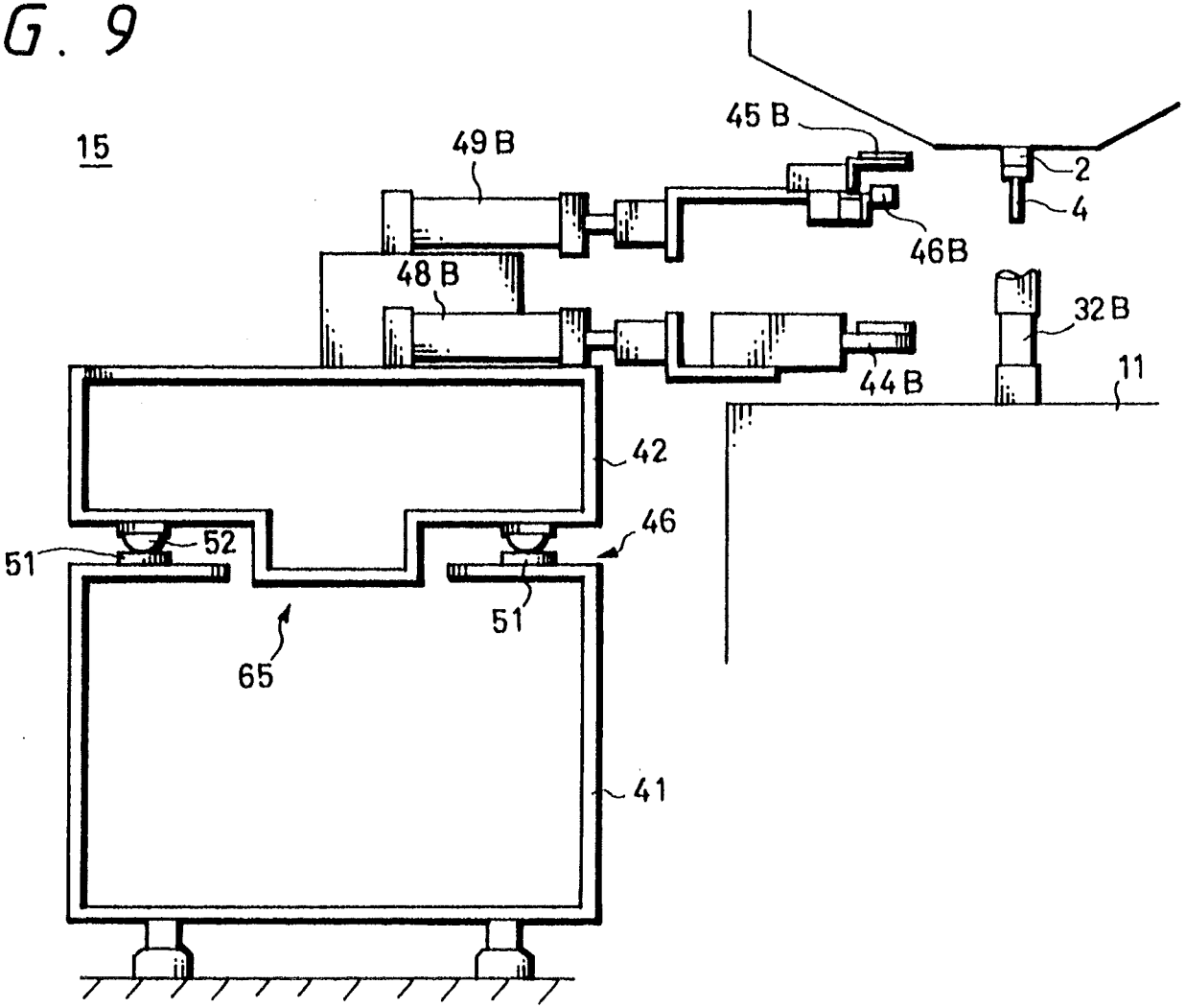
FIG. 9 is a side elevational view of a centering device for a cathode-ray tube bulb according to the present invention.
Figure 10:
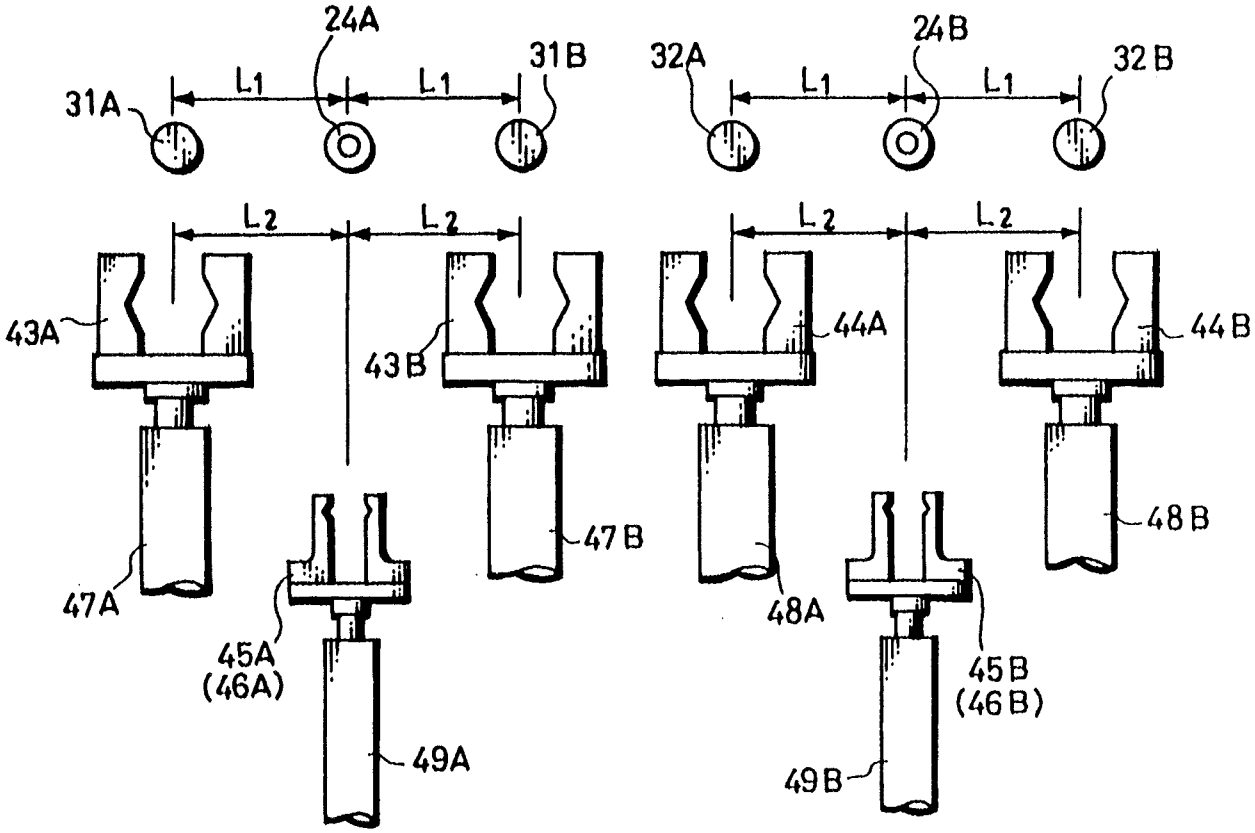
FIG. 10 is a schematic fragmentary plan view of the centering device.

As shown in FIGS. 9 and 10, the cathode-ray tube bulb centering device 15 includes a fixed base 41 and a movable base 42 mounted on the fixed base 41 by a floating mechanism 46 for movement in mutually perpendicular X and Y directions. On the movable base 42, there are supported two pairs of first chucks 43A, 43B and 44A, 44B for holding the support columns 31A, 31B and 32A, 32B, respectively, on opposite sides of the evacuating ports 24A, 24B of each evacuating cart 11, a pair of second chucks 45A, 45B for holding the neck 2 of each cathode-ray tube bulb 1, and a pair of third chucks 46A, 46B for holding the evacuating pipe 4 of each cathode-ray tube bulb 1.

The first chucks 43A, 43B and 44A, 44B can be moved forward and backward, i.e., toward and away from the support columns 31A, 31B and 32A, 32B, respectively, by respective control actuators, e.g., respective air cylinders 47A, 47B and 48A, 48B. The second and third chucks 45A, 46A are vertically aligned with each other, and can be moved forward and backward, i.e., toward and away from the neck 2 and the evacuating pipe 4, respectively, of one of the two cathode-ray tube bulbs 1 by a common control actuator, e.g., an air cylinder 49A. Similarly, the other second and third chucks 45B, 46B are vertically aligned with each other, and can be moved forward and backward, i.e., toward and away from the neck 2 and the evacuating pipe 4, respectively, of the other cathode-ray tube bulb 1 by another common control actuator, e.g., an air cylinder 49B. In FIG. 10, the third chucks 46A, 46B are omitted from illustration as they underlie the respective second chucks 45A, 45B.

The central axes of the first chucks 43A, 43B are spaced from the central axes of the second and third chucks 45A, 46A by a distance $L_2$ which is accurately the same as the distance $L_1$ between the central axis of each of the support columns 31A, 31B and the central axis of the evacuating port 24A ($L_1=L_2$). Likewise, the central axes of the first chucks 44A, 44B are also spaced from the central axes of the second and third chucks 45B, 46B by the distance L2 which is accurately the same as the distance $L_1$ between the central axis of each of the support columns 32A, 32B and the central axis of the evacuating port 24B.

Figure 11:
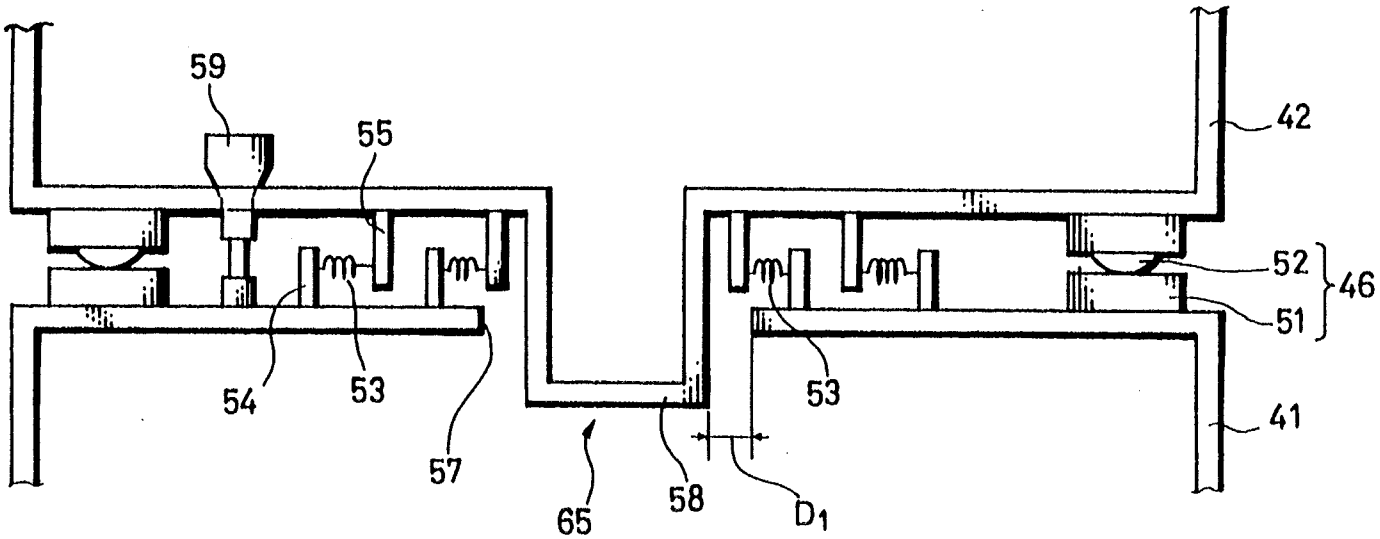
FIG. 11 is an elevational view of a floating mechanism according to the present invention.
Figure 12:
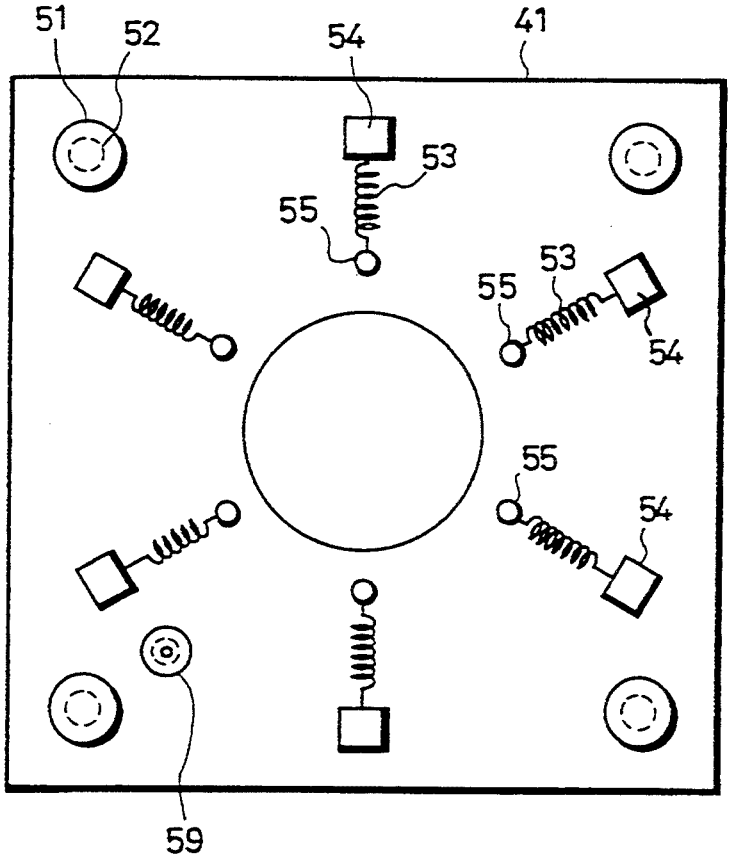
FIG. 12 is a plan view of the floating mechanism shown in FIG. 11.

As shown in FIGS. 9, 11, and 12, the floating mechanism 46 comprises a plurality of rests 51, i.e., four axisymmetric rests 51 in the illustrated embodiment, mounted on an upper surface of the fixed base 41, and a plurality of rotatable balls 52 mounted on a lower surface of the movable base 42 and held in rolling contact with the respective rests 51 for movement in the X and Y directions.

A plurality of springs 53, i.e., six axisymmetric springs 53, are interposed and act between the fixed base 41 and the movable base 42 for normally urging the center of the movable base 42 into alignment with the center of the fixed base 41. The springs 53 are coupled at ends to spring retainers 54 mounted on the fixed base 41 and at the other ends to spring retainers 55 mounted on the movable base 42.

The movable base 42 has an overfloating prevention mechanism 65 for limiting the floating movement thereof to a certain range. More specifically, as shown in FIG. 11, the movable base 42 includes a boss 58 downwardly projecting centrally from the lower surface thereof and inserted in an opening 57 defined centrally in the upper surface of the fixed base 41. The movable base 42 is horizontally movable with respect to the fixed base 41 in an interval corresponding to the distance $D_1$ between the edge of the opening 57 and the outer circumferential surface of the boss 58.

The cathode-ray tube bulb centering device 15 also includes a floating stop device 59 for securing the movable base 42 against wobbling movement which would otherwise be caused by the floating mechanism 46, while the first, second, and third chucks 43a, 43B, 44A, 44B, 45A, 45B, 46A, 46B are being moved by the air cylinders 47A, 47B ,48A, 48B, 49A, 49B.

Figure 13:
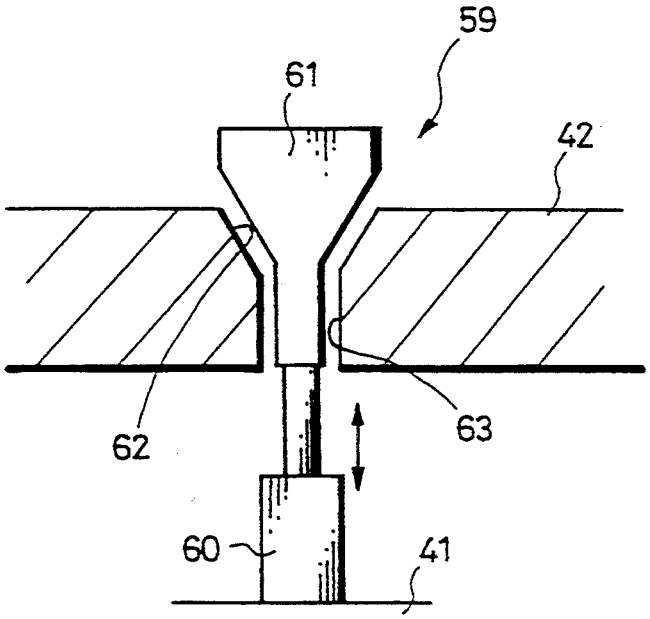
FIG. 13 is a view of a floating stop device according to the present invention.

As shown in FIG. 13, the floating stop device 59 comprises a wedge-shaped body 61 mounted on the fixed base 41 and vertically movable by a control actuator such as an air cylinder 50, for example, and a through hole 63 defined in a lower panel of the movable base 42 and having a tapered surface 63 for engaging the wedge-shaped body 61. When the wedge-shaped body 61 is lifted to an upper position and disengaged from the tapered surface 63 by the air cylinder 60, the movable base 42 is in a floating state and hence movable with respect to the fixed base 41. When the wedge-shaped body 61 is lowered into intimate contact with the tapered surface 63 by the air cylinder 60, the movable base 42 is fixed with respect to the fixed base 41, and no longer in the floating state.

The floating mechanism 46 may comprise an electromagnetic mechanism which operates based on superconductivity to make the movable base 42 floatingly movable with respect to the fixed base 41.

When the evacuating carts 11 are moved to and stopped at the position [14] where the cathode-ray tube bulb centering device 15 is positioned, the evacuating carts 11 tend to stop at slightly different positions.

To position each of the evacuating carts 11 accurately at the position [14], the cathode-ray tube bulb centering device 15 operates as follows: With the movable base 42 fixed with respect to the fixed base 41 by the floating stop device 59, the first chucks 43A, 43B, 44A, 44B as they are open are moved forward by the respective air cylinders 47A, 47B, 48A, 48b to positions in which they can grip the support columns 31A, 31B, 32A, 32B, respectively, of the evacuating cart 11. Then, the floating stop device 59 is inactivated to bring the movable base 42 into a floating state, after which the first chucks 43A, 43B, 44A, 44B grip the corresponding support columns 31A, 31B, 32A, 32B. Now, the movable base 42 is moved so as to follow the evacuating cart 11, and positioned with respect to the evacuating cart 11.

Then, the second and third chucks 45A, 46A and 45B, 46B as they are open are moved simultaneously forward by the respective air cylinders 49A, 49B, and the second chucks 45A, 45B grip the respective necks 2 of the corresponding cathode-ray tube bulbs 1, and then the third chucks 46A, 46B grip the respective evacuating pipes 4 thereof. In this manner, the cathode-ray tube bulbs 1 are brought into respective proper positions with respect to the evacuating cart 11, i.e., centered with respect to the evacuating cart 11, with the evacuating pipes 4 positioned above the evacuating ports 24A, 24B.

The second chucks 45A, 45B grip the respective necks 2 of the corresponding cathode-ray tube bulbs 1 out of physical interference with the glass stems 6 thereof as the glass stems 6 should be free of any scratches, cracks, or damage which would be responsible for possible vacuum leakage.

After the cathode-ray tube bulbs 1 have been centered on the evacuating cart 11, the first, second, and third chucks 43a, 43B, 44A, 44B, 45A, 45B, 46A, 46B are opened, and then retracted, i.e., moved backward, by the air cylinders 47A, 47B, 48A, 48B, 49A, 49B. Subsequently, the cathode-ray tube bulbs 1 are lowered with the holders 35, so that the evacuating pipes 4 are inserted into the respective evacuating ports 24A, 24B through the respective sealing jigs 46A, 46B.

The dummy evacuating pipe inserting/removing devices 22A, 22B are identical in structure to each other though they operate in different sequences.

Figure 14:
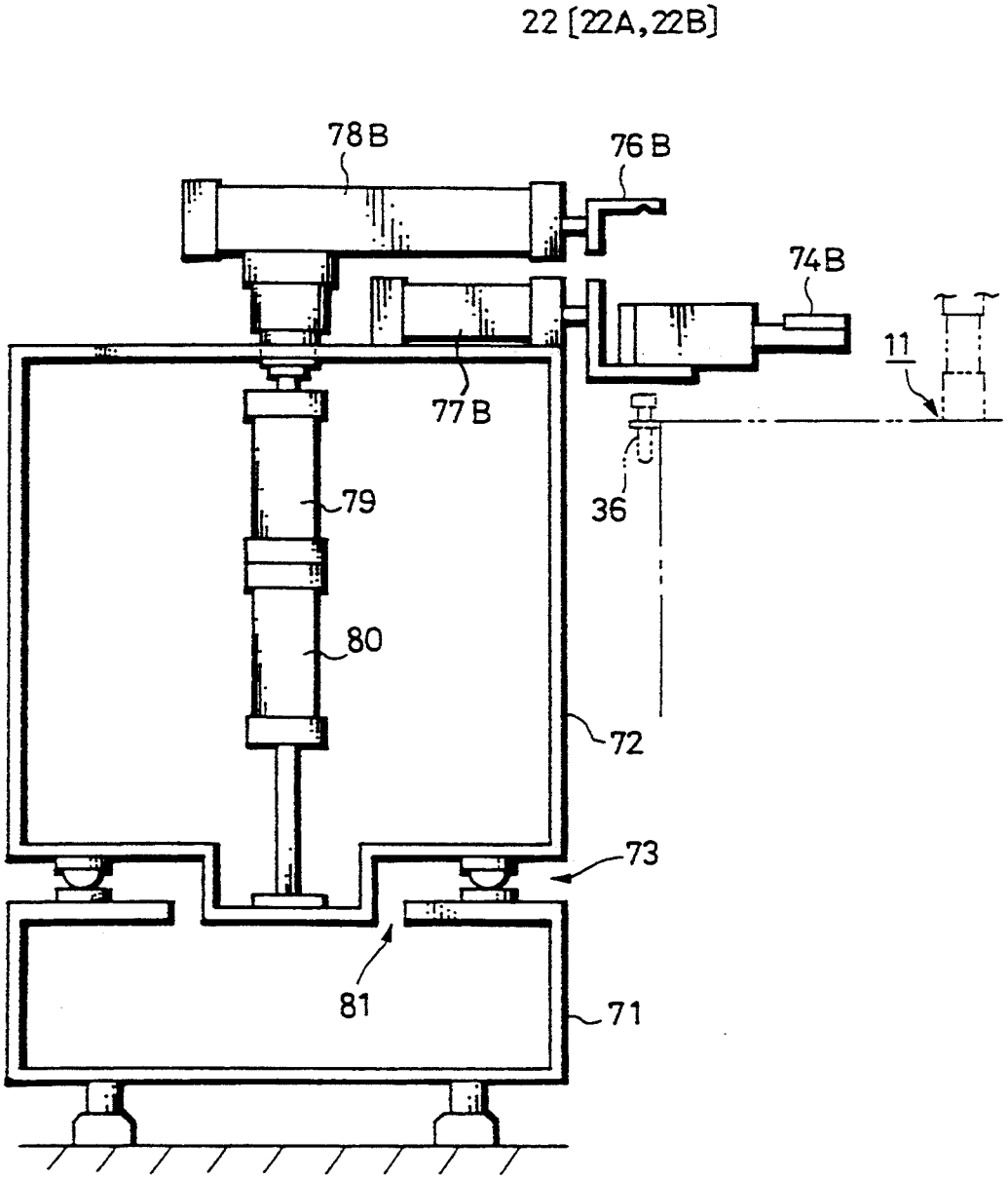
FIG. 14 is an elevational view of a dummy evacuating pipe inserting/removing device according to the present invention.
Figure 15:
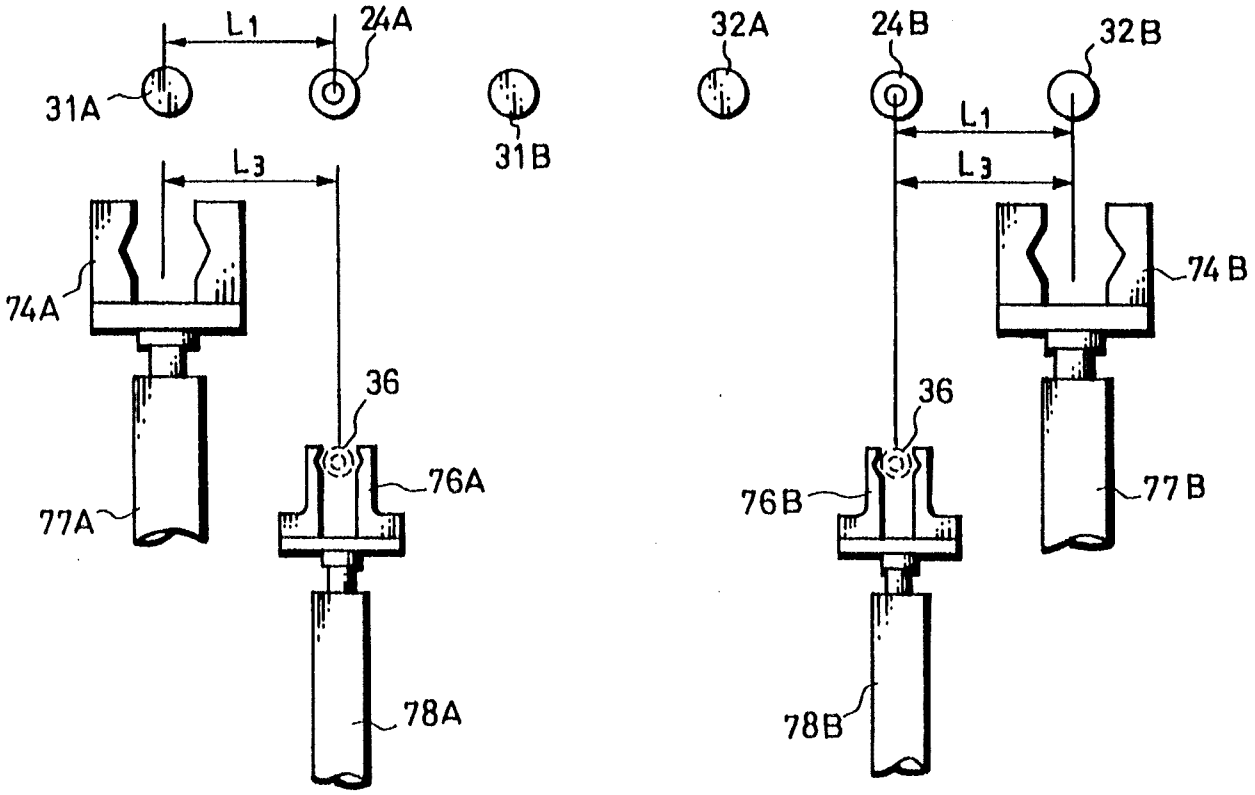
FIG. 15 is a plan view of the dummy evacuating pipe inserting/removing device shown in FIG. 14.

Each of the dummy evacuating pipe inserting/ removing devices 22A, 22B is substantially identical in structure to the cathode-ray tube bulb centering device 15. Specifically, as shown in FIGS. 14 and 15, each of the dummy evacuating pipe inserting/removing devices 22A, 22B comprises a fixed base 71 and a movable base 72 mounted on the fixed base 71 by a floating mechanism 73 for movement in mutually perpendicular X and Y directions. On the movable base 72, there are supported a pair of first chucks 74A, 74B for holding the outermost support columns 31A, 32B, respectively, of each evacuating cart 11, a pair of second chucks 76A, 76B for holding dummy evacuating pipes 36 and inserting or removing them into or from the evacuating ports 24A, 24B of the evacuating cart 11.

The first chucks 74A, 74B can be moved forward and backward, i.e., toward and away from the support columns 31A, 32B, respectively, by respective control actuators, e.g., respective air cylinders 77A, 77B. The second chucks 76A, 76B can be moved forward and backward, i.e., toward and away from the evacuating ports 24A, 24B, respectively, by respective control actuators, e.g., respective air cylinders 78A, 78B. The second chucks 76A, 76B can also be moved vertically by respective pairs of control actuators, e.g., air cylinders 79, 80.

The central axis of the first chuck 74A is spaced from the central axis of the second chuck 76A by a distance $L_3$ which is accurately the same as the distance $L_1$ between the central axis of each of the support columns 31A, 31B and the central axis of the evacuating port 24A ($L_1=L_3$). Likewise, the central axis of the first chuck 74B is spaced from the central axis of the second chuck 76B by the distance $L_3$ which is accurately the same as the distance $L_1$ between the central axis of each of the support columns 32A, 32B and the central axis of the evacuating port 24B.

Each of the dummy evacuating pipe inserting-/removing devices 22A, 22B also has a floating mechanism 73, an overfloating prevention mechanism 81, and a floating stop device (not shown) which are identical in structure to the floating mechanism 46, an overfloating prevention mechanism 65, and the floating stop device 59 shown in FIGS. 11 through 13. Therefore, the floating mechanism 73, the overfloating prevention mechanism 81, and the floating stop device will not be described in detail below.

When the evacuating carts 11 are moved to and stopped at the position [11] where the dummy evacuating pipe inserting device 22A is positioned and the position [2] where the dummy evacuating pipe removing device 22B is positioned, the evacuating carts 11 tend to stop at slightly different positions.

In the dummy evacuating pipe inserting device 22A, the movable base 72 is fixed with respect to the fixed base 71 by the floating stop device, and the first chucks 74A, 74B as they are open are moved forward by the respective air cylinders 77A, 77B to positions in which they can grip the support columns 31A, 32B, respectively, of the evacuating cart 11. Then, the floating stop device is inactivated to bring the movable base 72 into a floating state, after which the first chucks 74A, 74B grip the corresponding support columns 31A, 32B. Now, the movable base 72 is moved so as to follow the evacuating cart 11, and positioned with respect to the evacuating cart 11.

Figure 16:
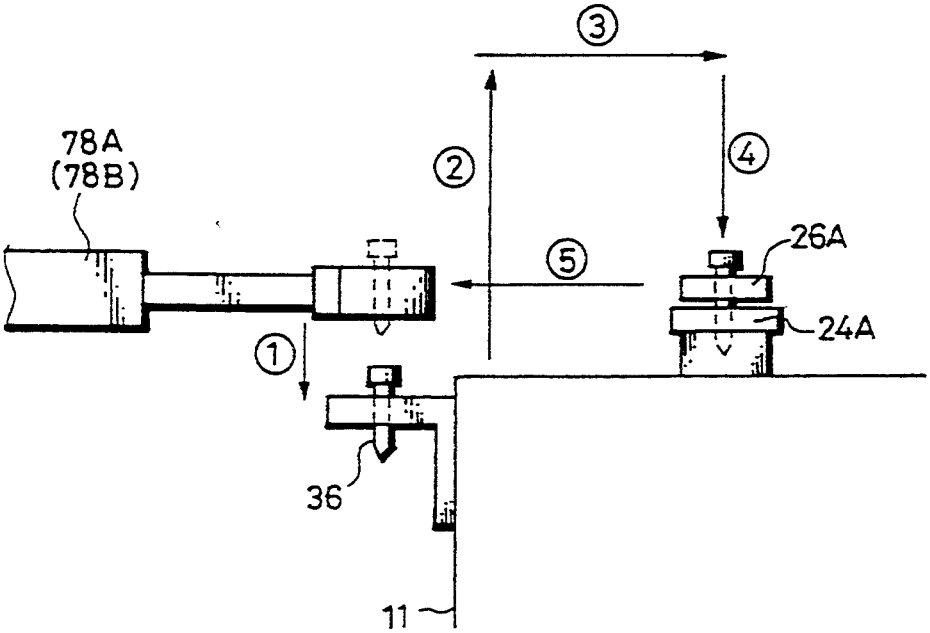
FIG. 16 is a view showing the manner in which the dummy evacuating pipe inserting/removing device operates.

Then, as shown in FIG. 16, the second chucks 76A, 76B are lowered as indicated at (1) by the air cylinders 80, grip dummy evacuating pips 36 stored on the front end of the evacuating cart 11, and then are elevated as indicated at (2) by the air cylinders 80, 79. Thereafter, the second chucks 76A, 76B are moved forward as indicated at (3) by the respective air cylinders 78A, 78B, until they are positioned over the respective evacuating ports 24A, 24B. Then, the second chucks 76A, 76B are lowered as indicated at (4) by the air cylinders 79, thereby inserting the dummy evacuating pips 36 through the respective sealing jigs 26A, 26B into the evacuating ports 24A, 24B. After the dummy evacuating pips 36 are inserted in the evacuating ports 24A, 24B, the second chucks 76A, 76B are opened and retracted to their original positions by the air cylinders 78A, 78B.

Figure 17:
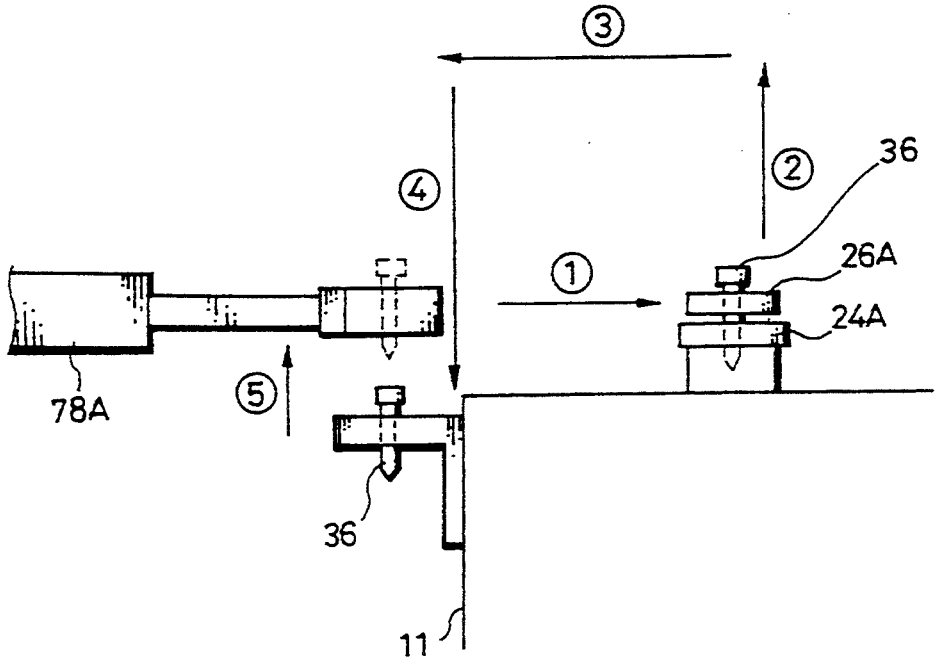
FIG. 17 is a view showing the manner in which the dummy evacuating pipe removing device operates.

In the dummy evacuating pipe inserting device 22B, the first chucks 74A, 74B grip the support columns 31A, 32B, respectively, of the evacuating cart 11, thus positioning the movable base 72 with respect to the evacuating cart 11. Thereafter, as shown in FIG. 17, the second chucks 76A, 76B are moved forward as indicated at (1) by the air cylinders 78A, 78B, grip dummy evacuating pips 36 inserted in the evacuating ports 24A, 24B, and then are elevated as indicated at (2) by the air cylinders 79. Thereafter, the second chucks 76A, 76B are moved backward as indicated at (3) by the respective air cylinders 76A, 76B, and then lowered as indicated at (4) by the air cylinders 79, 80, thereby storing the dummy evacuating pips 36 in the respective storage members 37A, 37B. Subsequently, the second chucks 76A, 76B are opened, and elevated as indicated by (5) by the air cylinders 80 and placed in a standby mode their original positions.

Figure 21B:
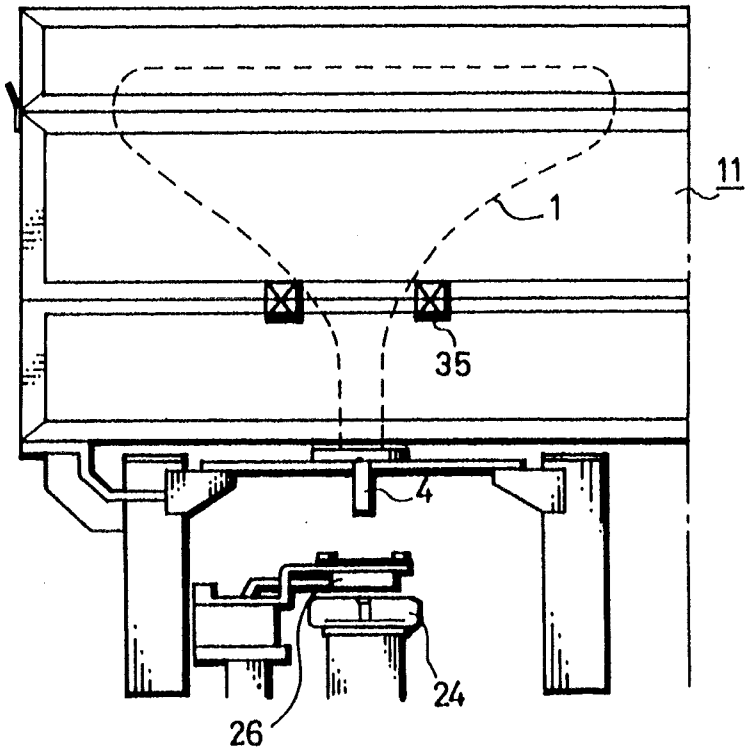
FIGS. 21A and 21B are views illustrative of the manner in which an evacuating pipe is detected.
Figure 21A:
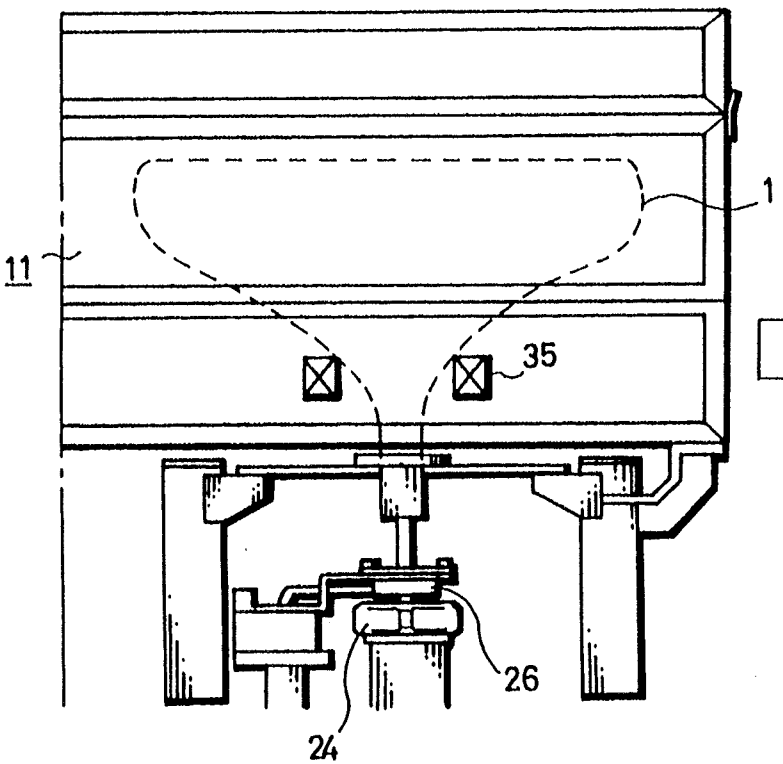
Figure 22B:
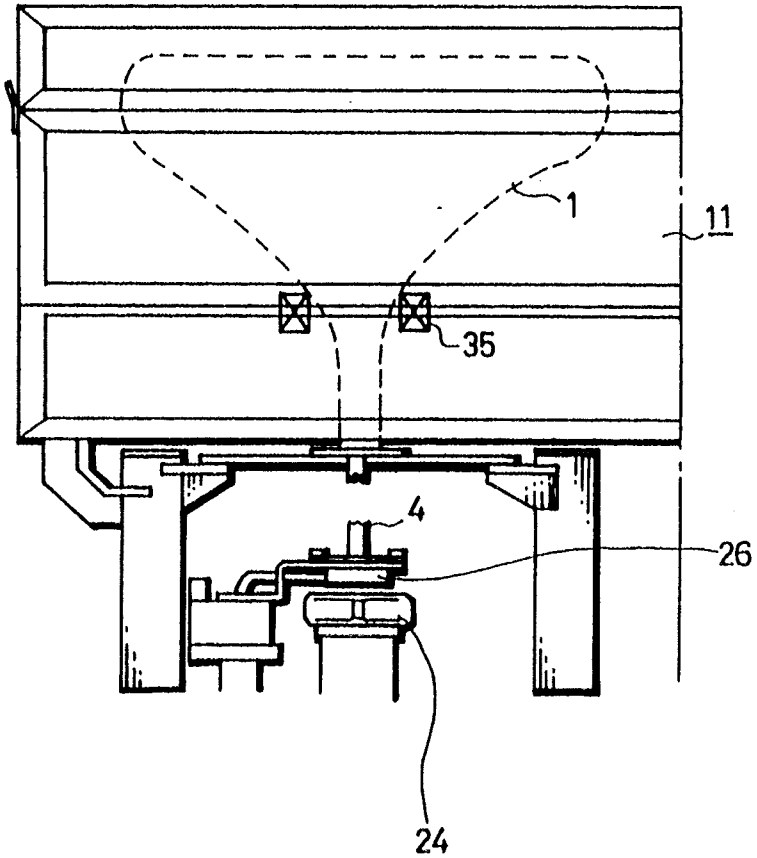
FIGS. 22A and 22B are views illustrative of the manner in which an evacuating pipe is detected.
Figure 22A:
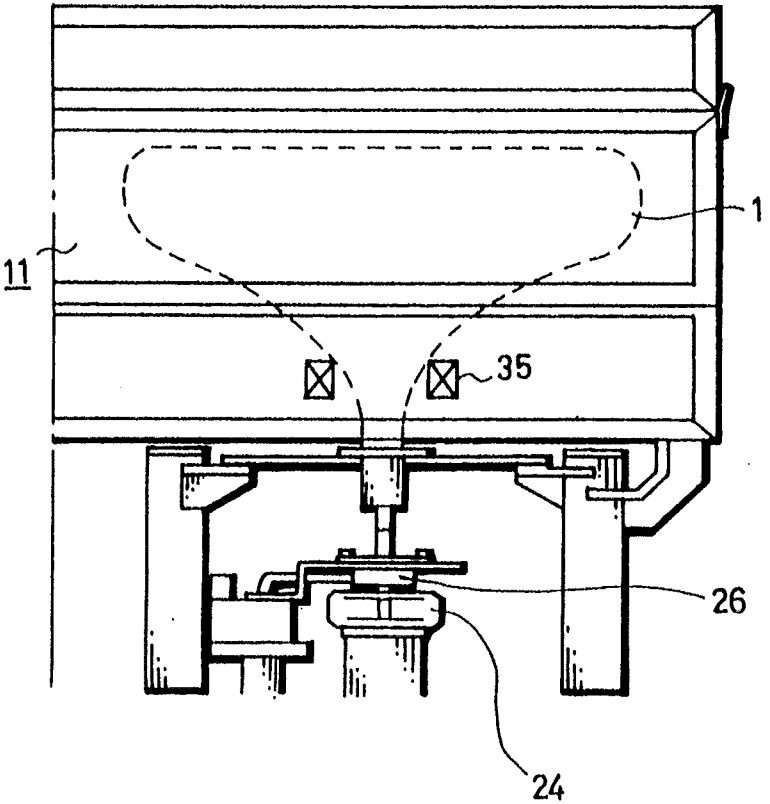

The evacuating pipe detecting device 18 will be described below. Normally, a cathode-ray tube bulb 1 which has emerged out of the evacuating furnace 13 is moved such that its evacuating pipe 4 inserted through any of the sealing jigs 26A, 26B (indicated by 26) in the corresponding evacuating port 24A, 24B (indicated by 24) as shown in FIG. 21A is released from the sealing jig 26 and the evacuating port 24 as shown in FIG. 21B in preparation for processing by the automatic cathode-ray tube bulb removing device 19. If, however, the sealed evacuating pipe 4 is broken for some reason as shown in FIG. 22A and remains in the evacuating ports 24 as shown in FIG. 22B, then when another cathode-ray tube bulb 1 will subsequently be transferred to the evacuating cart 11, the remaining evacuating pipe 4 will interfere with the evacuating pipe 4 of the newly transferred cathode-ray tube bulb 1. Therefore, it is necessary to detect an evacuating pipe with the evacuating pipe detecting device 18.

Figure 23:
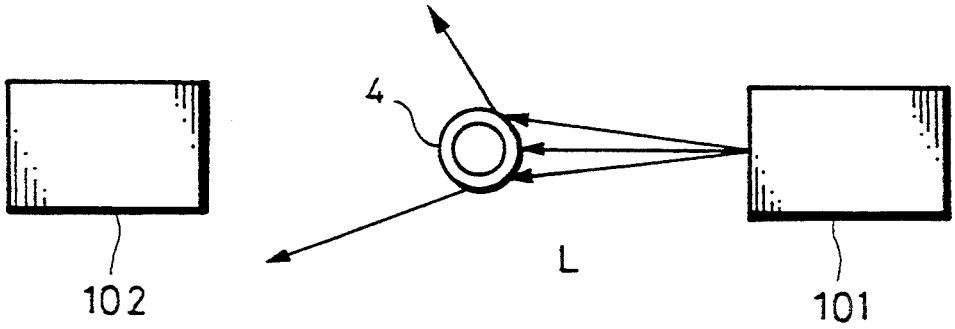
FIG. 23 is a view illustrative of the manner in which an evacuating pipe is detected.

A sensor which utilizes light usually suffers difficulty in detecting colorless transparent glass. In view of the fact that an evacuating pipe 4 has a diameter of several millimeters, however, if a light beam used to detect the evacuating pipe 4 is narrower than the evacuating pipe 4, then, as shown in FIG. 23, when light L is applied to the evacuating pipe 4, the light L is reflected and scattered in a complex pattern by the surface of the evacuating pipe 4. Accordingly, a photoelectric sensor (see FIG. 18) composed of a light-emitting element 101 and a light-detecting element 102 is effective to detect whether there is an evacuating pipe 4 between the light-emitting element 101 and the light-detecting element 102.

Figure 18:
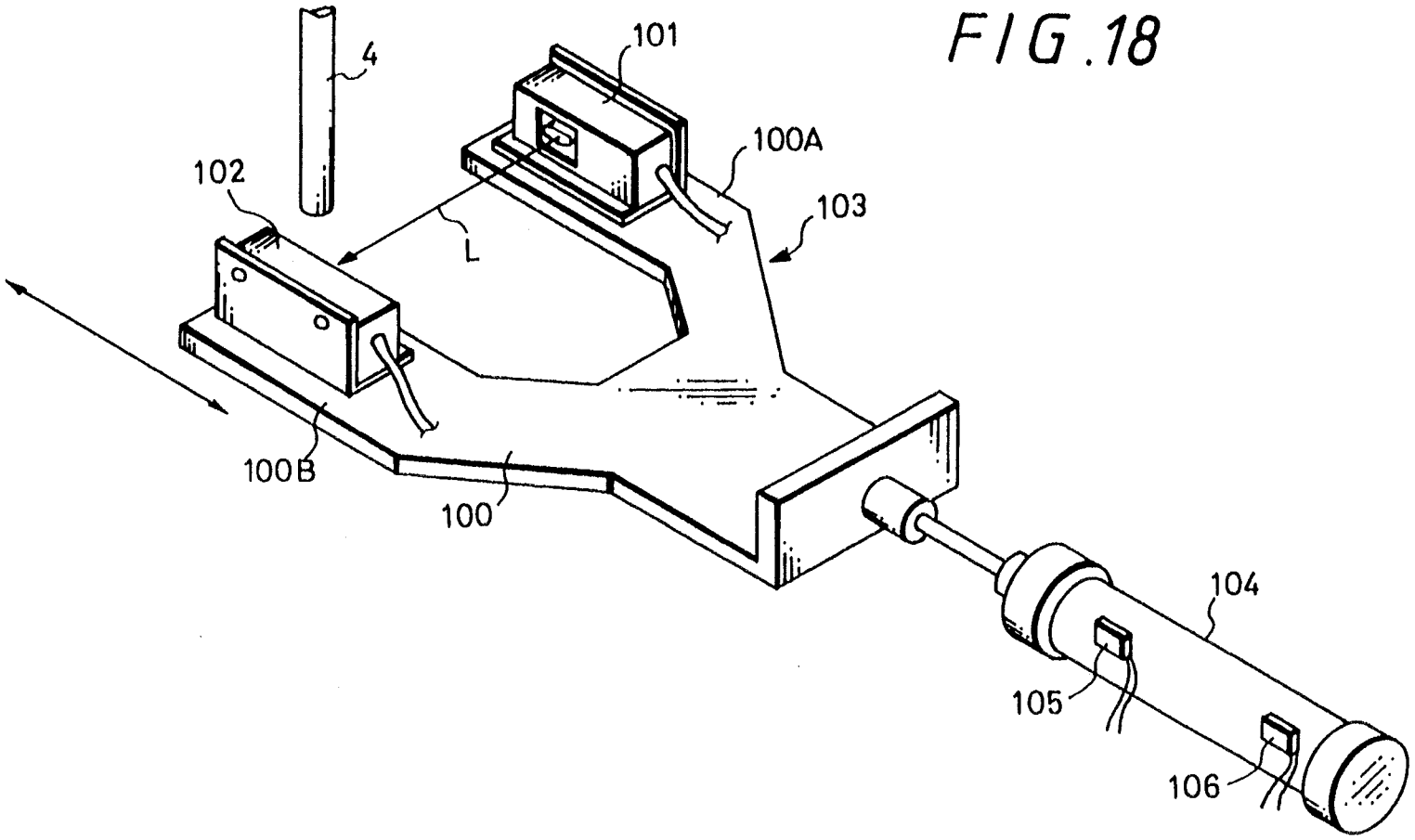
FIG. 18 is a perspective view of an evacuating pipe detecting device.

As shown in FIG. 18, the evacuating pipe detecting device 18 comprises a photoelectric sensor unit 103 including a substantially U-shaped support plate 100 having two spaced confronting arms 100A, 100B on which the light-emitting element 101 and the light-detecting element 102 are supported, respectively, and a control actuator such as an air cylinder 104 for moving the photoelectric sensor unit 103 forward and backward. The air cylinder 104 is associated with sensors 105, 106 for detecting forward and backward movement thereof.

When no object exists between the light-emitting element 101 and the light-detecting element 102 and hence light traveling therebetween is not blocked, the photoelectric sensor unit 103 is turned off. When there is an object between the light-emitting element 101 and the light-detecting element 102 and hence light traveling therebetween is blocked, the photoelectric sensor unit 103 is turned on.

After a cathode-ray tube bulb 1 that has been evacuated and sealed is lifted with the holders to remove the evacuating pipe 4 from the sealing jig 26 and the evacuating port 24 in the position [3], the photoelectric sensor unit 103 is moved back and forth, i.e., makes one cycle of reciprocating movement, by the air cylinder 104.

Figure 20A:
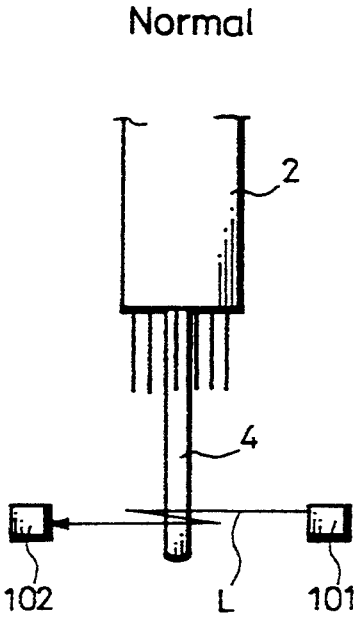
FIGS. 20A and 20B are diagrams illustrative of operation of the evacuating pipe detecting device shown in FIG. 18.

If the evacuating pipe 4 is not broken, then, as shown in FIG. 20A, since the evacuating pipe 4 is present between the light-emitting element 101 and the light-detecting element 102, and light emitted from the light-emitting element 101 is blocked by the evacuating pipe 4, the photoelectric sensor unit 103 is turned on. Therefore, it can be confirmed that the evacuating pipe 4 is not broken.

Figure 20B:
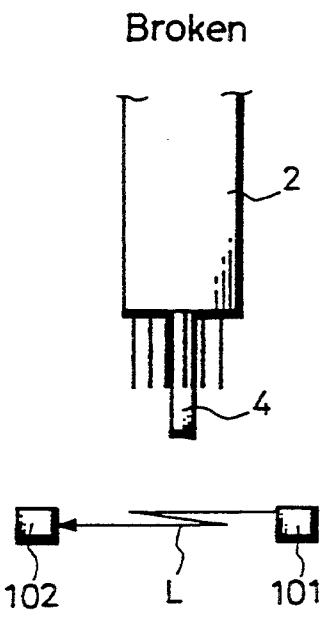

If no evacuating pipe 4 is present between the light-emitting element 101 and the light-detecting element 102, then, as shown in FIG. 20B, the photoelectric sensor unit 103 is turned off, making it possible to confirm that the evacuating pipe 4 is broken and remains in the evacuating port 24 of the evacuating cart 11.

Figure 19A:
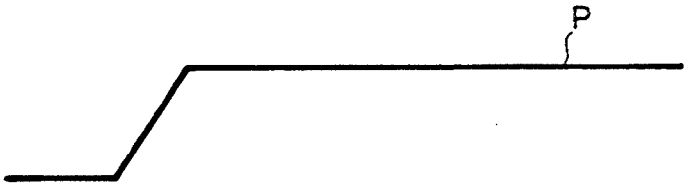
FIGS. 19A, 19B, and 19C are diagrams illustrative of operation of the evacuating pipe detecting device shown in FIG. 18.
Figure 19B:
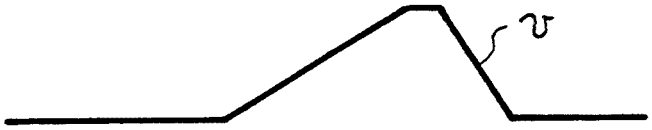
Figure 19C:
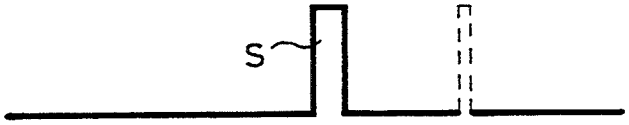

The photoelectric sensor unit 103 is moved forward and backward at different speeds as shown in FIGS. 19B. More specifically, after the cathode-ray tube bulb 1 has been elevated as indicated by the curve P in FIG. 19A, the photoelectric sensor unit 103 is moved forward at a lower speed in order to pick up a detected signal S reliably from the photoelectric sensor, and moved backward at a higher speed as indicted by the curve V in FIG. 19B. The higher speed of backward movement of the photoelectric sensor unit 103 is achieved by controlling the rate of flow of air supplied to operate the air cylinder 104 which controls the movement of the photoelectric sensor unit 103.

When the evacuating pipe 4 can be detected until the backward movement of the photoelectric sensor unit 103 is completed, the cathode-ray tube bulb 1 is regarded as being good.

When the light L from the light-emitting element 101 is not blocked until the backward movement of the photoelectric sensor unit 103 is completed, the photoelectric sensor unit 103 transmits a signal to an external controller of the apparatus, indicating that the evacuating pipe 4 is broken.

The evacuating cart 11 on which the broken evacuating pipe 4 is left is removed out of the apparatus at the position [6], thus avoiding any secondary hazard or accident which would otherwise tend to happen if another cathode-ray tube bulb 1 were charged onto the evacuating cart 11 with the remaining evacuating pipe 4.

After the evacuating cart 11 on which the broken evacuating pipe 4 is left is discharged, a replacement evacuating cart 11 is charged into the apparatus at the position [7].

Figure 24:
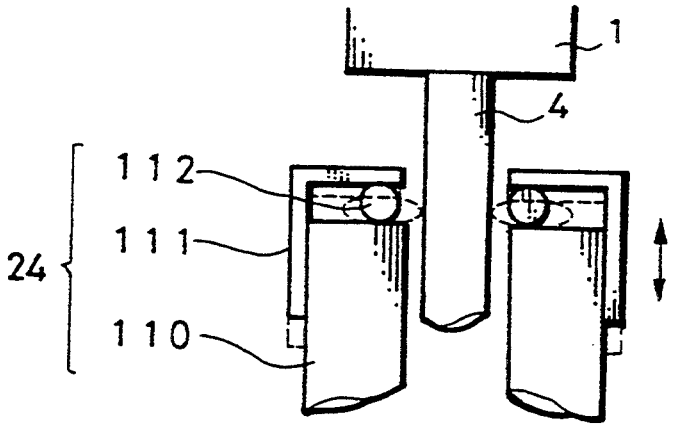
FIG. 24 is a fragmentary cross-sectional view of an evacuating port according to the present invention.
Figure 25:
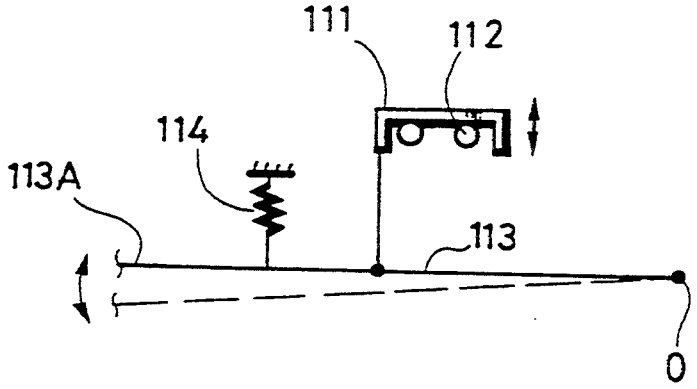
FIG. 25 is a diagram showing the principles of tightening and loosening the evacuating port.

As shown in FIG. 24, the evacuating port 24 has a port rubber seal ring 112 disposed between an evacuating pipe insertion member 110 and a cap 111 placed on the end of the evacuating pipe insertion member 110. As schematically shown in FIG. 25, the cap 111 is connected to an intermediate portion of a lever 113 that is angularly movable about an end thereof as a fulcrum 0. The lever 113 is normally urged by a spring 114 to turn in a direction to loose the cap 111, i.e., bias the cap 111 away from the end of the evacuating pipe insertion member 110. When the opposite end 113A of the lever 113 is moved, the cap 111 is moved away from and toward the end of the evacuating pipe insertion member 110, elastically releasing and deforming the port rubber seal ring 112 thereby to remove and provide a seal between the evacuating port 24 and the evacuating port 4.

As shown in FIG. 7, the evacuating cart 11 has two engaging hooks 115 for engaging respective ends 113A of levers 113 which project outwardly.

Figure 26A:
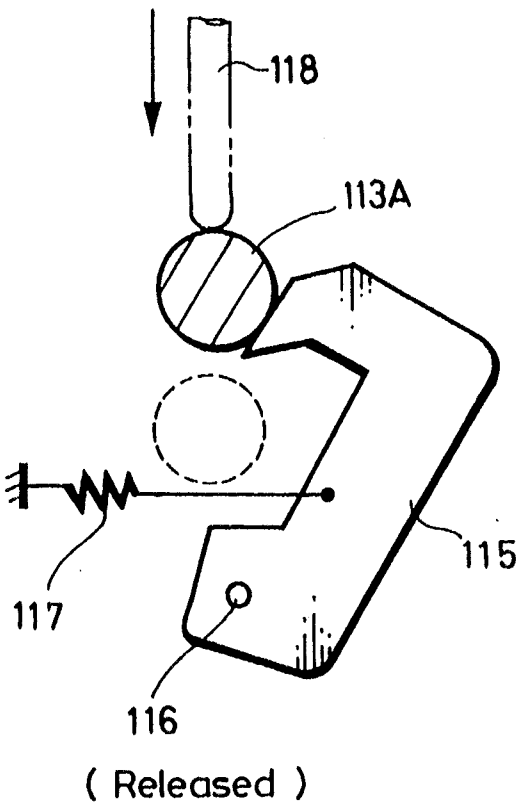
FIGS. 26A and 26B are views showing the manner in which the evacuating port is tightened.
Figure 26B:
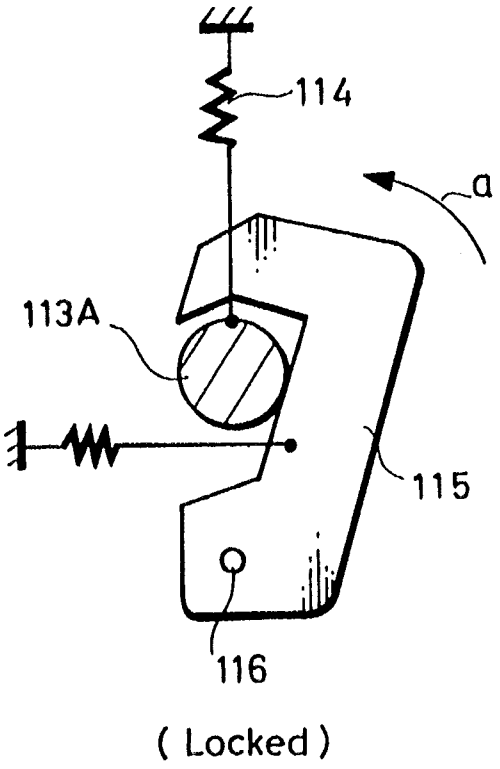

As shown in FIGS. 26A and 26B, each of the engaging hooks 115 has one end pivotally mounted on a panel of the evacuating cart 11 by a pivot pin 116, and is normally urged by a spring 117 to turn counterclockwise about the pivot pin 116.

The evacuating port tightening device 16 is primarily composed of the port rubber seal ring 112, the lever 113, and the engaging hook 115. The evacuating port tightening device 16 also has a actuating rod 118 for lowering the lever end 113A as shown in FIG. 26A.

Figure 3:
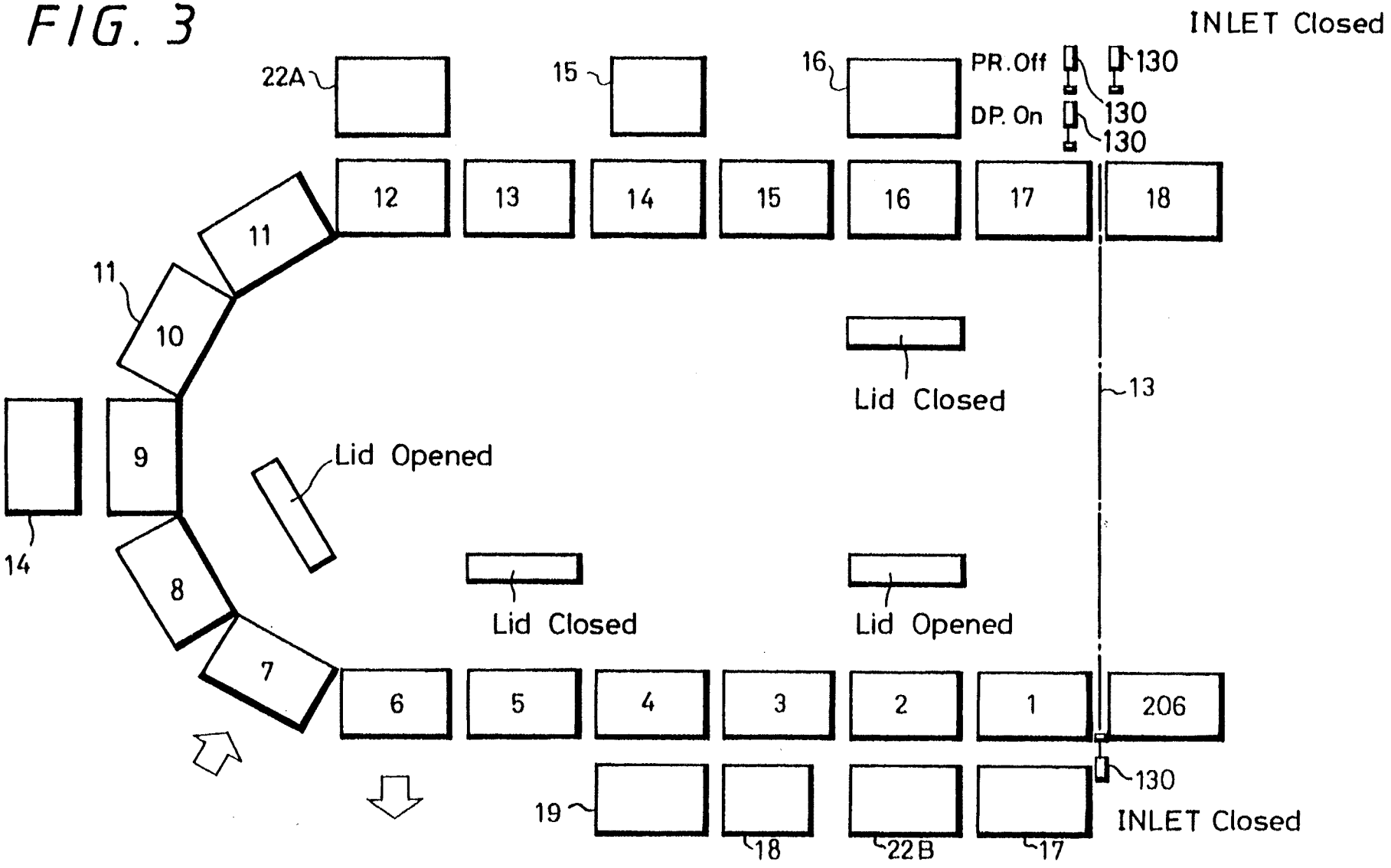
FIG. 3 is an enlarged fragmentary plan view of the apparatus shown in FIG. 2.

When an evacuating cart 11 with the evacuating pipe 4 of a cathode-ray tube bulb 1 being inserted in an evacuating port 24 is fed to the position [16]shown in FIG. 3, the lever end 113A which is in a released position in FIG. 26A is lowered against the bias of the spring 14 by the actuating rod 118 of the evacuating port tightening device 16. The hook 115 and the lever end 113A are disengaged from each other, and the hook 115 is turned clockwise as indicated by the arrow a about the pivot pin 116 under the bias of the spring 117 as shown in FIG. 26B. The hook 115 now locks the lever end 113A of the lever 113 that is lowered. Since the lever 113 is lowered, the cap 111 coupled to the lever 113 is lowered, thus pressing and elastically deforming the port rubber seal ring 112 to tighten the evacuating port 24 to prevent vacuum leakage from between the evacuating port 24 and the evacuating pipe 4.

Figures 27A, 27B:
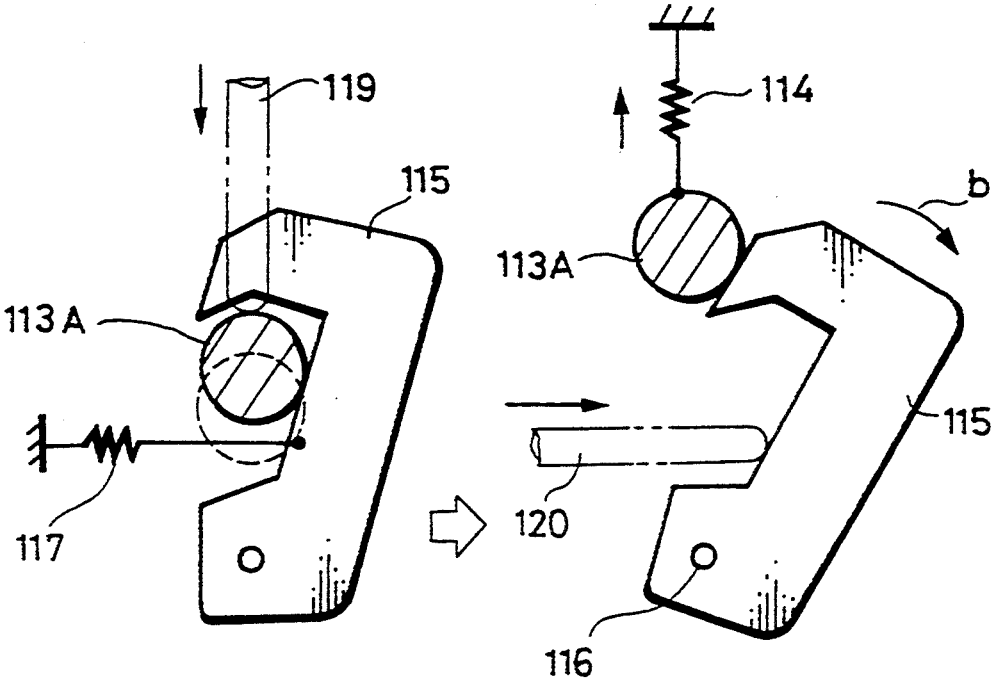
FIGS. 27A and 27B are views showing the manner in which the evacuating port is loosened.

As shown in FIGS. 27A and 27B, the evacuating port tightening device 16 also includes a first operating rod 119 for slightly lowering the lever end 113A to a position in which the hook 115 can easily be disengaged from the lever end 113A, and a second operating rod 120 for turning the hook 115 clockwise as indicated by the arrow b about the pivot pin 116 against the bias of the spring 117.

When an evacuating cart 11 is discharged from the evacuating furnace 13 to the position [1] shown in FIG. 3 after a sealing process, the lever end 113A locked as shown in FIG. 27A is slightly depressed by the first operating rod 119 until the hook 115 is disengaged from the lever end 113A against the spring 114. At the same time, the second operating rod 120 turns the hook 115 clockwise as indicated by the arrow b about the pivot pin 116. Now, as shown in FIG. 27B, the lever end 113A moves upwardly out of engagement with the hook 115 under the bias of the spring 114. Upon upward movement of the lever 113 under the bias of the spring 114, the cap 111 returns upwardly to its original position, allowing the port rubber seal ring 112 to restore its original shape, thus loosening the evacuating port 24.

As shown in FIG. 7, the evacuating cart 11 has five limit switches 122 ~126, i.e., a limit switch 112 for turning on and off an oil rotation pump, a limit switch 123 for turning on and off an oil dispersion pump, a limit switch 124 for opening and closing an air opening to return the pressure in the two pumps slowly to the atmospheric pressure after a sealing process, and a pair of limit switches 125 for turning on and off the right- and left-hand sealing jigs to separately heat the two evacuating pipes 4 on the evacuating cart 11.

Figure 28:
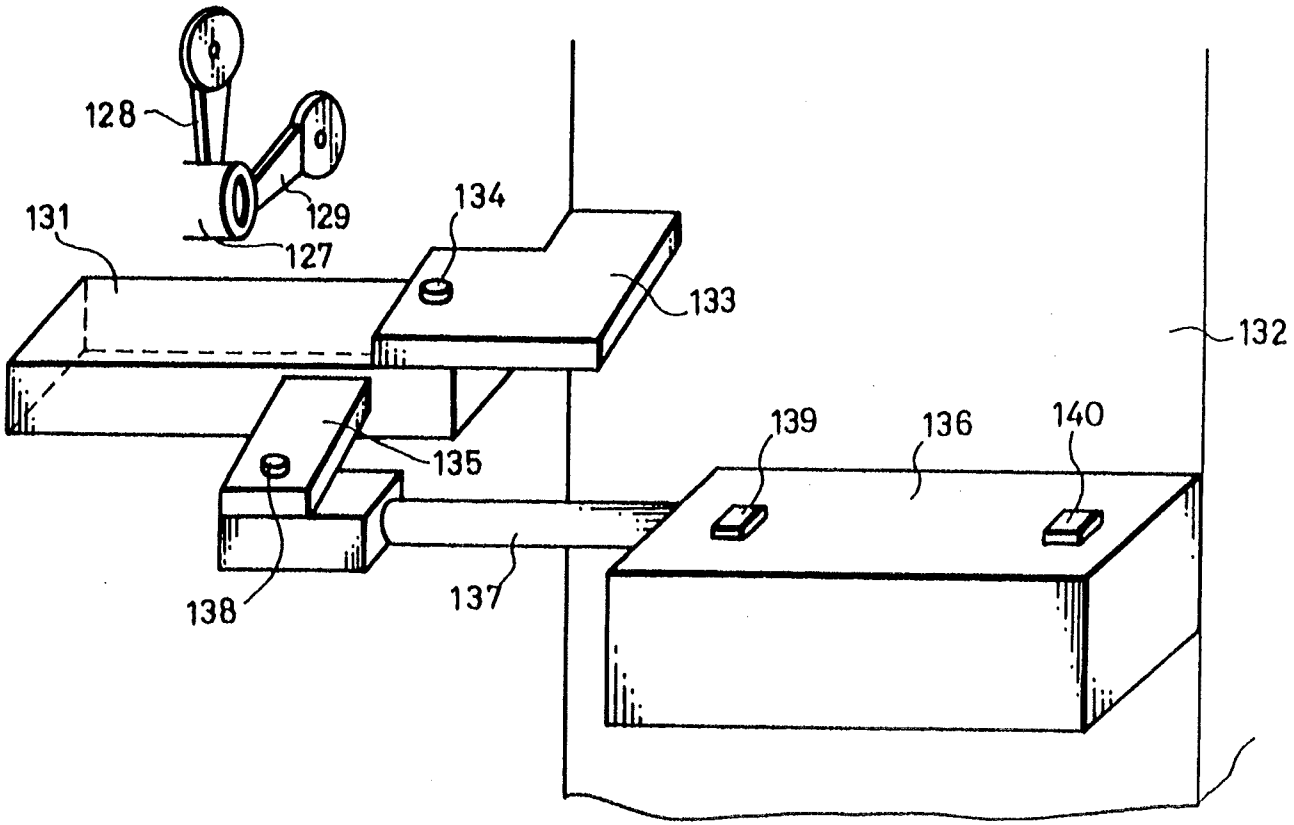
FIG. 28 is a perspective view of a limit switch actuator according to the present invention.
Figure 30:
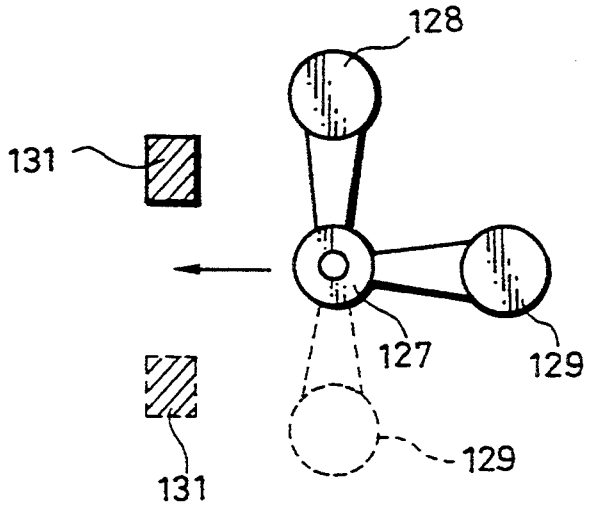
FIG. 30 is a view showing the relationship between a limit switch and the limit switch actuator.

As shown in FIGS. 28 and 30, each of the limit switches 122 ~126 has a pair of actuator arms 128, 129 integral with a rotatable shaft 127 which are angularly spaced 90° from each other and angularly movable in a plane normal to the rotatable shaft 127. As the evacuating cart 11 moves, the actuator arm 128 or 129 is turned 90° by a switch actuating bar 131 (described later on), thus actuating the limit switch.

A limit switch actuator 130 for actuating each of the limit switches 122 ~126 is located at each of the positions [18], [179], [199], and [1], for example.

As shown in FIGS. 28 and 30, the limit switch actuator 130 has a switch actuating bar 131 with an end thereof rotatably attached by a shaft 134 to a fixed member 133 which is fixed to a support 132. The switch actuating bar 131 has an integral arm 135 integrally extending from a side thereof and having a free end rotatably connected by a shaft 138 to a distal end of a rod 137 of a control actuator such as an air cylinder 136. Sensors 139, 140 are mounted on front and rear side surfaces of the air cylinder 136.

Figure 29:
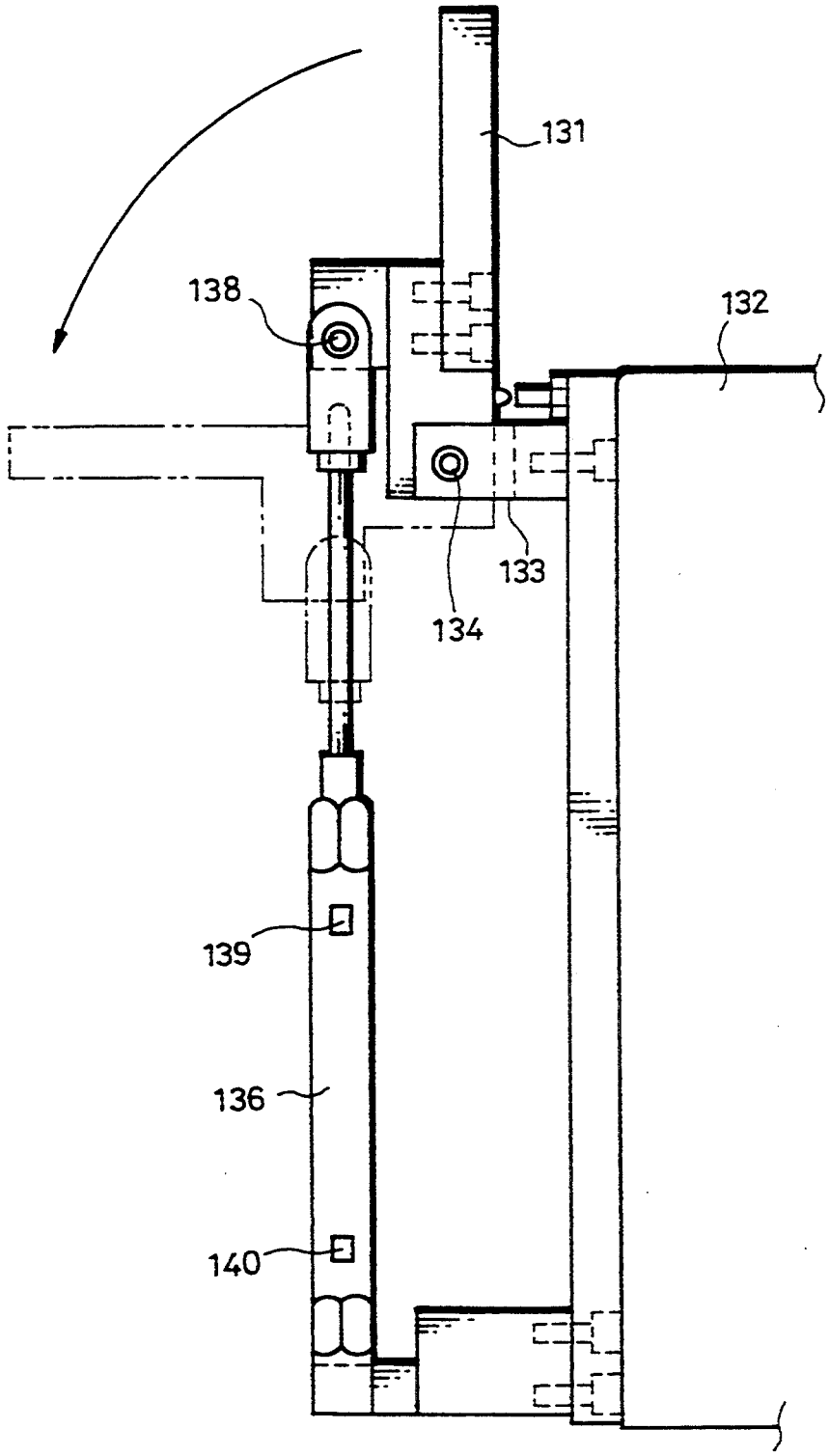
FIG. 29 is a view showing the manner in which the limit switch actuator operates.

For actuating each of the limit switches 122 ~126, the rod 137 of the air cylinder 136 is projected to the solid-line position shown in FIGS. 28 and 29. When the evacuating cart 11 moves under this condition, the arm 128 or 129 of the limit switch is pressed by the switch actuating bar 131 for angular movement through 90° into a horizontal position about the rotatable shaft 127.

If the switch actuating bar 131 is engaged by the rotatable shaft 127 of each of the limit switches 122 ~126 for some reason, then, as shown in the two-dot-and-dash lines in FIG. 29, the switch actuating bar 131 is turned 90° about the shafts 134, 138. The rod 137 of the air cylinder 136 is retracted, and the sensor 139 switches from the on-state to the off-state, whereupon such an abnormal condition can be detected.

If it is assumed that the force required for the switch actuating bar 131 to actuate any of the limit switches 122 ~126 under normal condition is represented by $F_1$, the force applied to the switch actuating bar 131 under abnormal condition by $F_2$, and the pneumatic pressure of the air cylinder 136 by $F_3$, then these forces and pressure are selected to meet the relationship: $F_2 > F_3 > F_1$.

In the position [18], the switch actuating bars 131 of the limit switch actuators 130 for turning on the oil rotation pump and the oil dispersion pump and closing the air opening for these pumps are positioned in the solid-line position shown in FIG. 30 when the limit switch actuators 130 operate ( see FIGS. 2 and 3).

Figure 5:
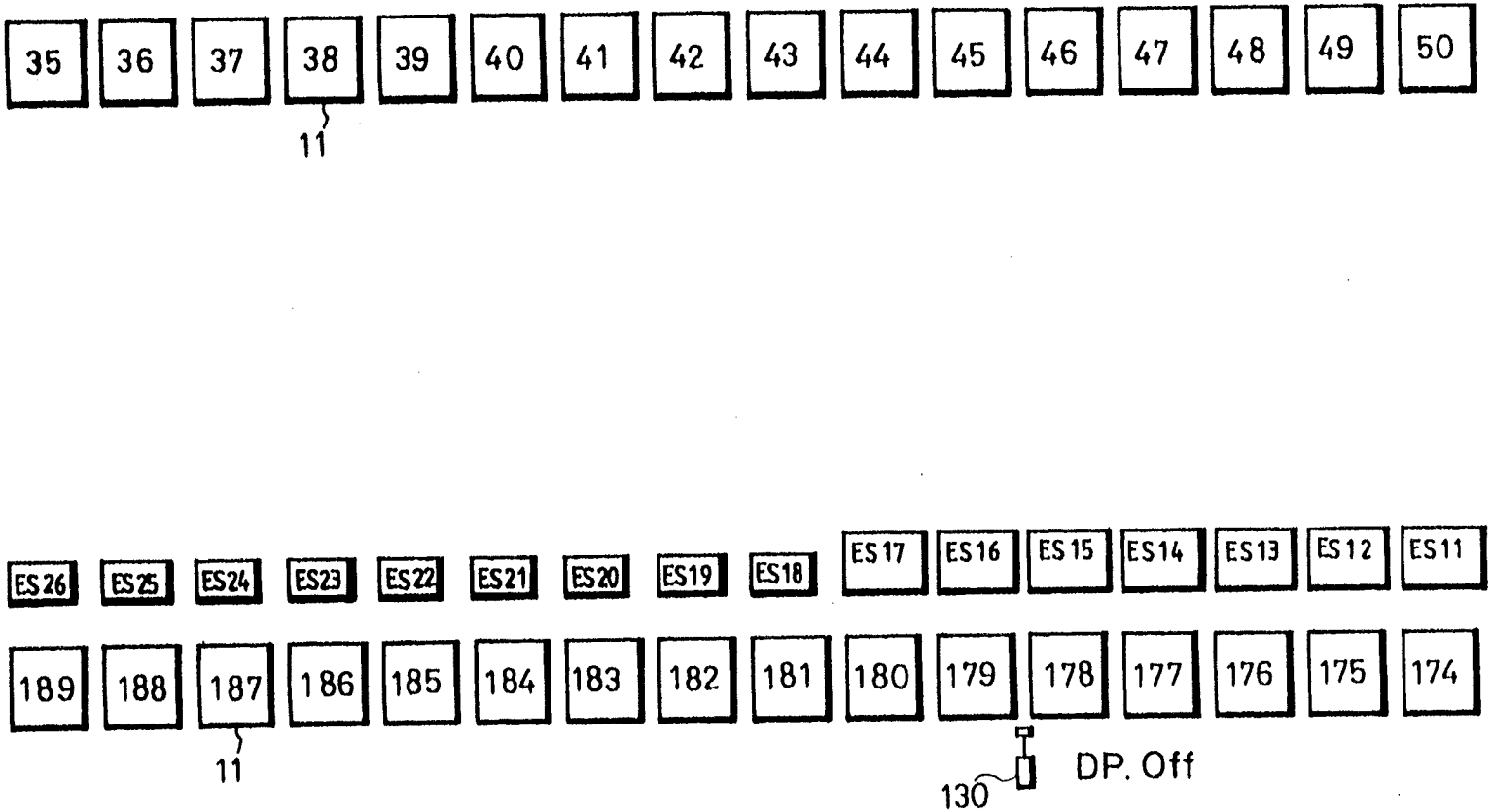
FIG. 5 is an enlarged fragmentary plan view of the apparatus shown in FIG. 2.

In the position [179], the switch actuating bar 131 of the limit switch actuator 130 for turning off the oil dispersion pump is positioned in the broken-line position shown in FIG. 30 when the limit switch actuator 130 operates (see FIGS. 2 and 5).

Figure 4:
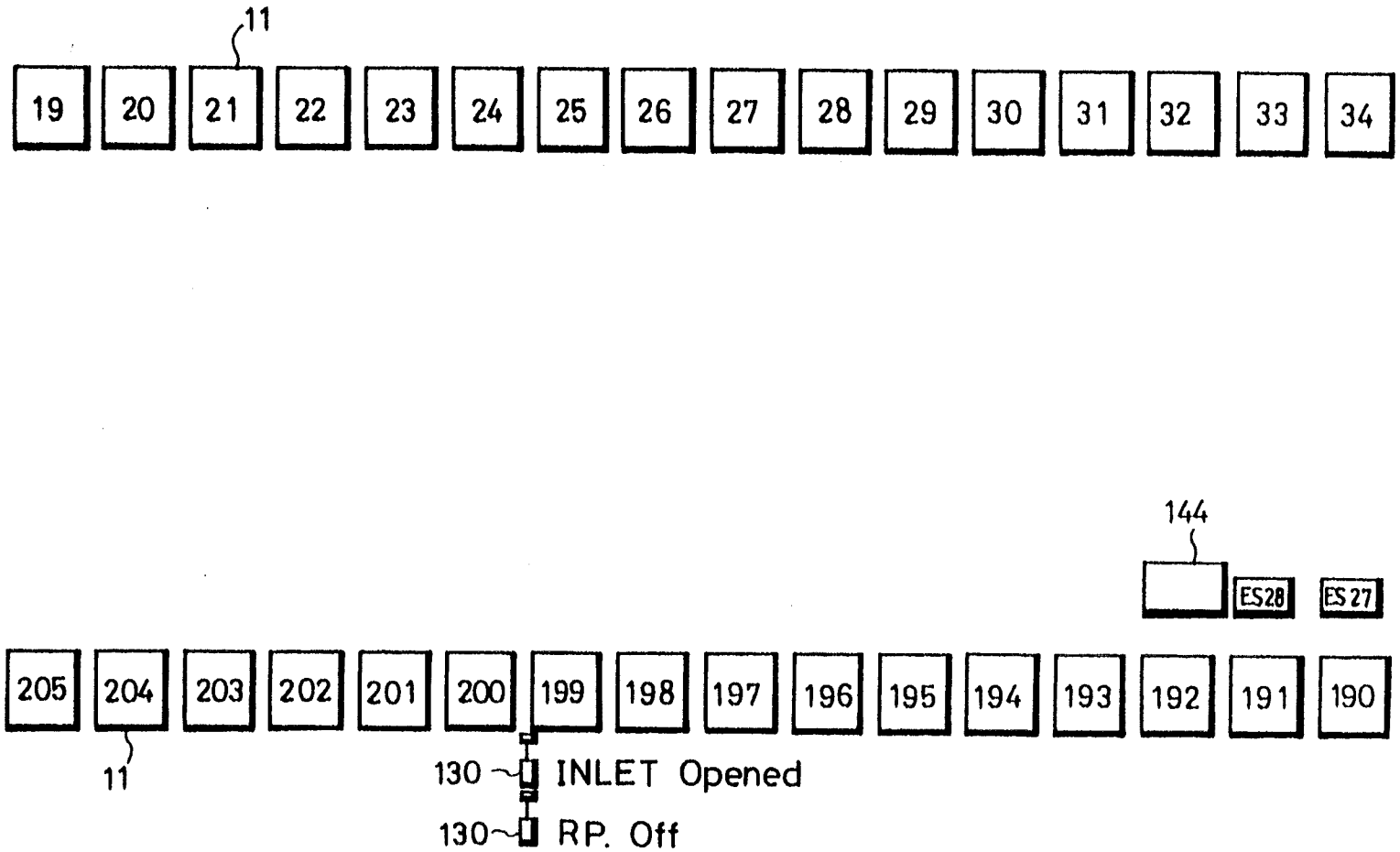
FIG. 4 is an enlarged fragmentary plan view of the apparatus shown in FIG. 2.

In the position [199], the switch actuating bars 131 of the limit switch actuators 130 for turning off the oil rotation pump and opening the air opening for both the pumps are positioned in the broken-line position shown in FIG. 30 when the limit switch actuators 130 operate (see FIGS. 2 and 4).

In the position [1], the switch actuating bar 131 of the limit switch actuator 130 for closing the air opening for both the pumps is positioned in the broken-line position shown in FIG. 30 when the limit switch actuator 130 operates (see FIGS. 2 and 3).

Figure 6:
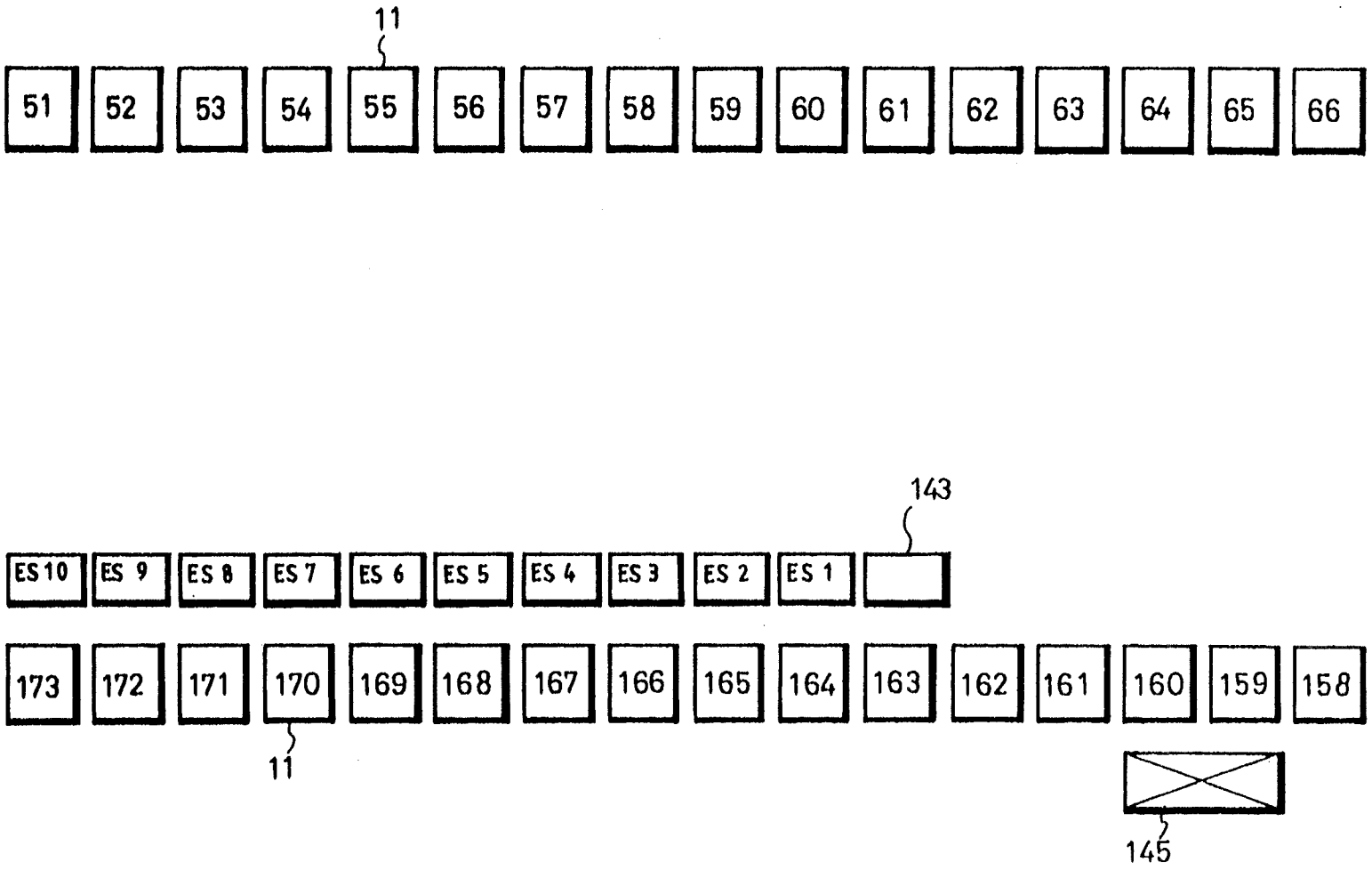
FIG. 6 is an enlarged fragmentary plan view of the apparatus shown in FIG. 2.

The sealing power feeding devices $ES_1$~$ES28$ each for supplying a voltage to the sealing jigs 26 on a evacuating cart 11 for sealing cathode-ray tube bulbs 1 thereon are located in the respective positions [164]~[191] in the evacuating furnace 13 (see FIGS. 3, 5, and 6).

The automatic sealing jig detecting devices 143, 144 (see FIGS. 6 and 4) for detecting a sealing jig failure are located at the position [163] immediately preceding the sealing process and the position [192 ] immediately following the sealing process.

A vacuum measuring device 145 for determining whether a predetermined correct vacuum has been achieved in a cathode-ray tube bulb 1 evacuated in the evacuating furnace 13 is positioned upstream of the automatic sealing jig detecting device 143. If a predetermined correct vacuum has been achieved as detected by the vacuum measuring device 145, then the evacuating pipe 4 of the cathode-ray tube bulb 1 is subsequently sealed. If a predetermined correct vacuum has not been achieved as detected by the vacuum measuring device 145, then the evacuating pipe 4 of the cathode-ray tube bulb 1 is not subsequently sealed.

As shown in FIG. 8, various spring-like terminals 146 connected to the sealing power feeding devices $ES_1$-~$ES_{28}$ and the automatic sealing jig detecting devices 143, 144 are mounted on a rear panel of each of the evacuating carts 11. These terminals 146 are brought into resilient contact with terminal rails on devices while the evacuating cart 11 is moving.

The terminals 146 include terminals C, G, K(CF), $F_1$, $F_2$ for measuring a vacuum, an alarm terminal ALM (ground) and an alarm terminal ALM for indicating a malfunction of the evacuating cart 11, and terminals $ES_{COM}$, ESL, ESR for applying a given voltage to the sealing jigs 26A, 26B on the evacuating cart 11.

Figure 31:
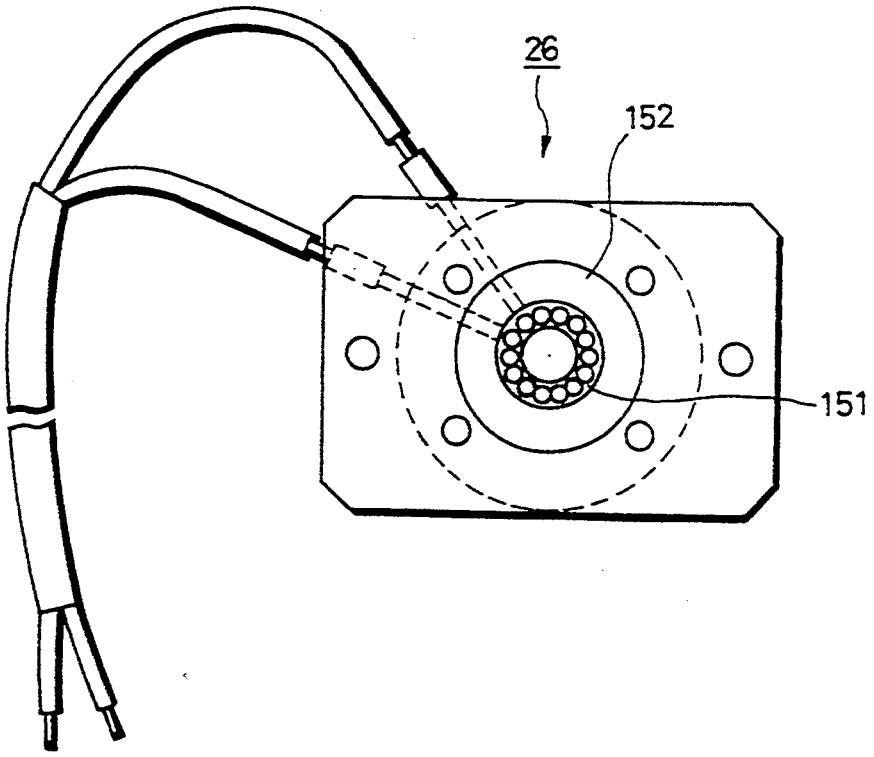
FIG. 31 is a plan view of a sealing jig according to the present invention.
Figure 32:
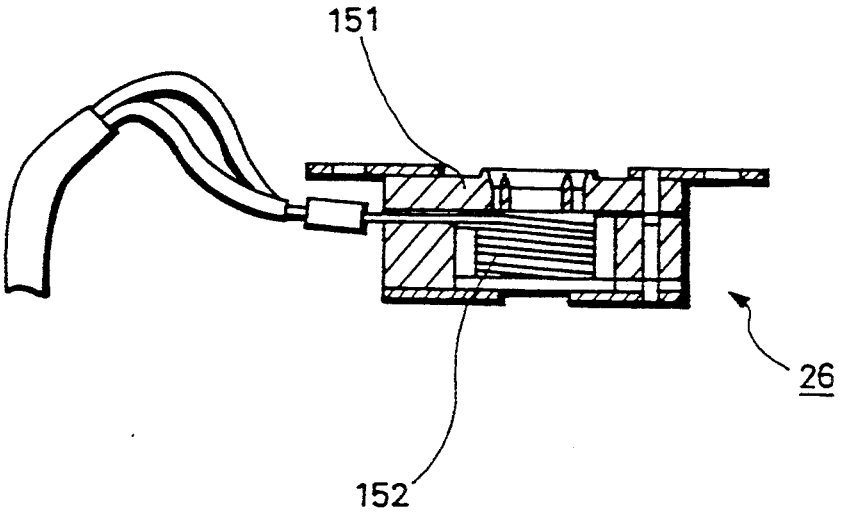
FIG. 32 is a cross-sectional view of the sealing jig.
Figure 33:
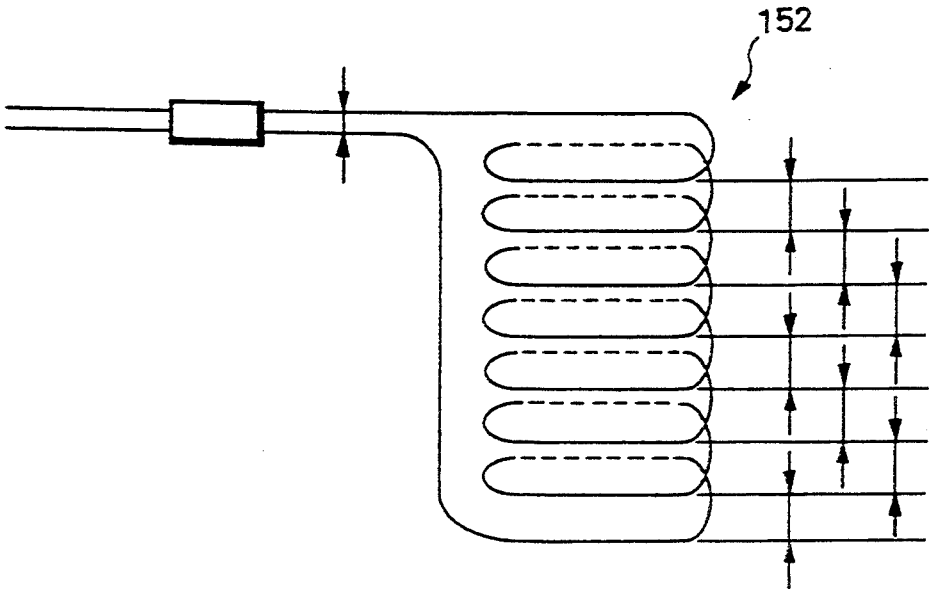
FIG. 33 is a schematic view of a coil heater of the sealing jig.

As shown in FIGS. 31 and 32, each of the sealing jigs 26A, 26B (indicated by 26) has a stem pin insertion member 151 and a sealing coil heater 152 positioned next to the stem pin insertion member 151 in coaxial alignment therewith for receiving an evacuating pipe 4 inserted therein. When a current is supplied to the coil heater 152, the coil heater 152 is heated to melt and seal the evacuating pip 4 inserted therein. As shown in FIG. 33, the coil heater 152 has seven coil turns, for example.

Figure 34:
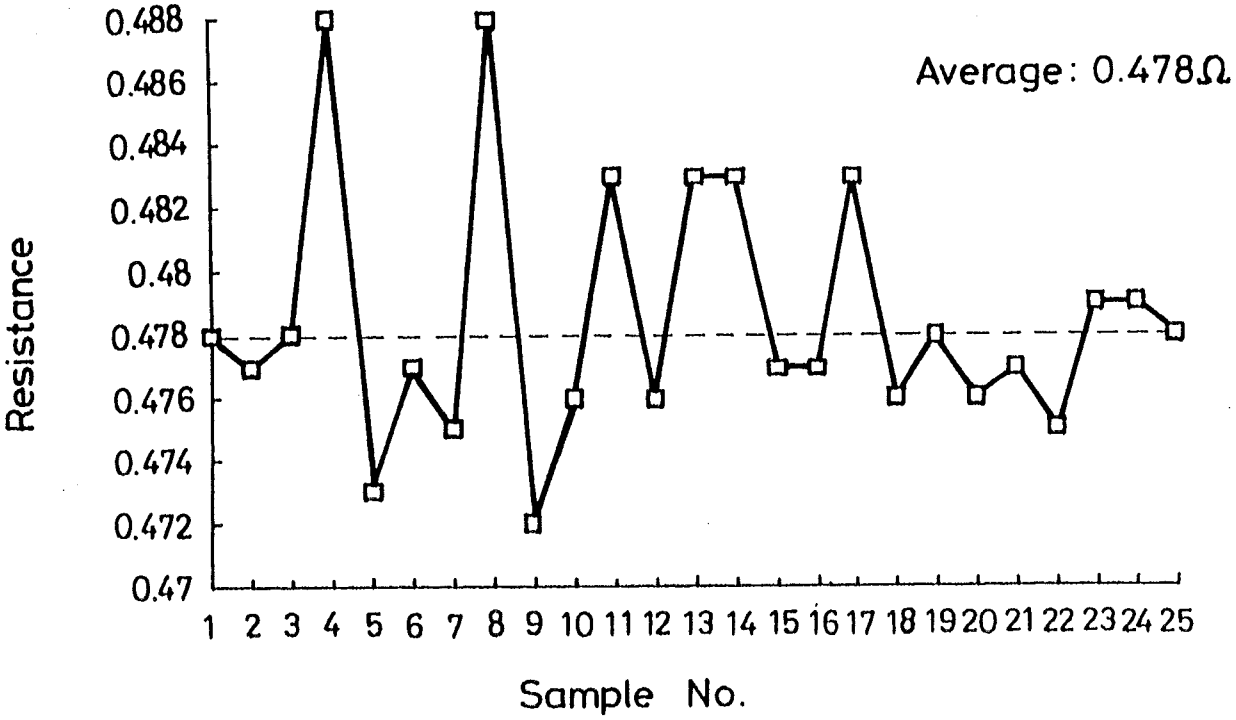
FIG. 34 is a graph showing the average resistance of sealing jigs.

As shown in FIG. 34, the sealing jig 26 has an average resistance of 0,478 ( Ω) which is an arithmetic mean value calculated from 25 sample sealing jigs. In order to minimize resistance variations of the coil heaters 152, each of the sealing jigs has a variable resistor 153 (see FIG. 35) for adjusting the coil heater resistance.

The sealing jigs 26A, 26B on the evacuating carts 11 are supplied with a predetermined amount of electric power from a constant-voltage power supply through the sealing power feeding devices (sealing units) $ES_1$-~$ES_{28}$. The evacuating pipes 4 are heated to temperatures having predetermined temperature distributions depending on the positions [164]~[191]. The sealing jigs 26A, 26B on the evacuating carts 11 are supplied with voltages depending on the temperature distributions through the sealing power feeding devices $ES_1$-~$ES_{28}$.

Figure 35:
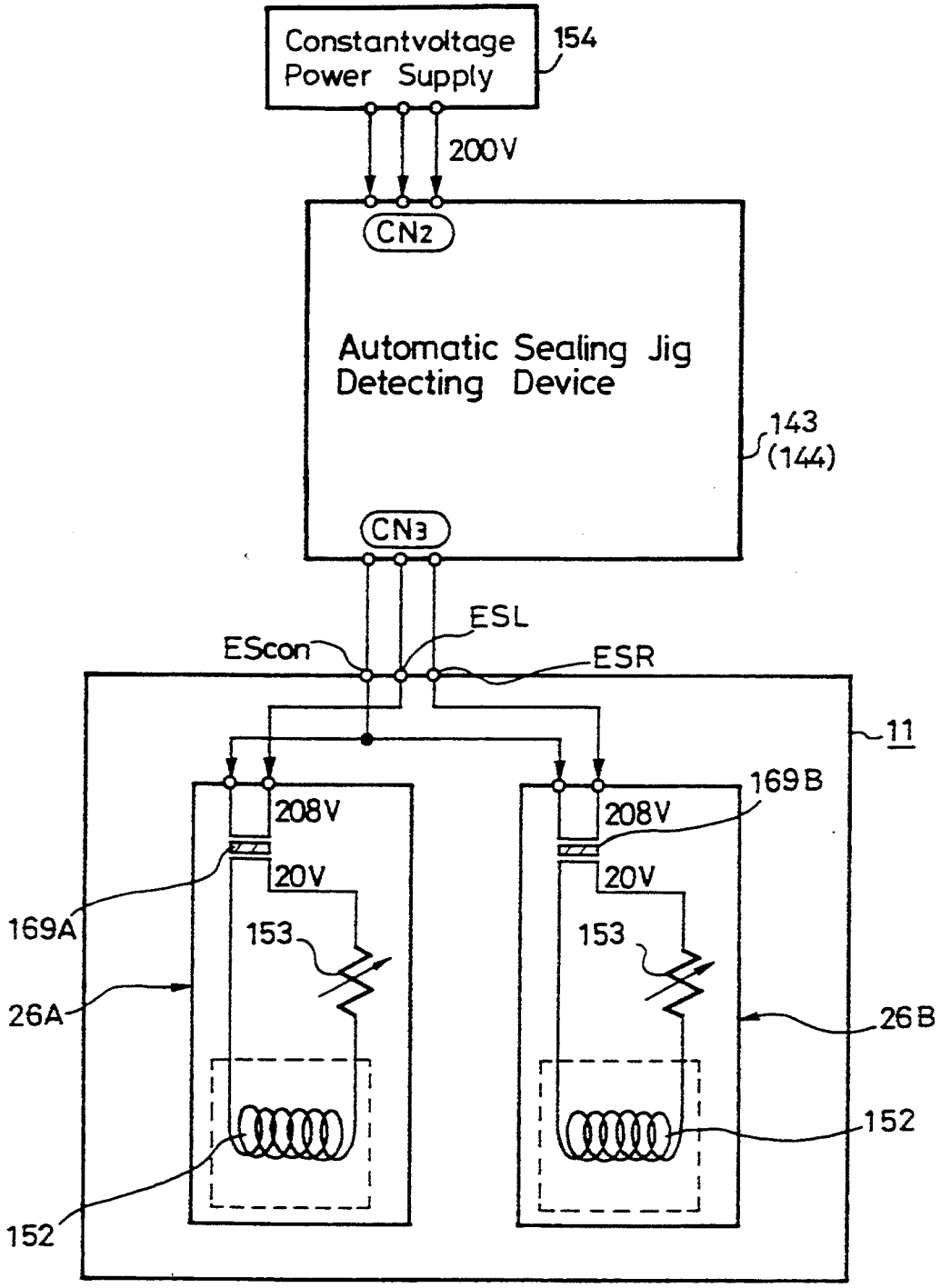
FIG. 35 is a diagram showing the relationship between an evacuating cart and an automatic sealing jig detecting device according to the present invention.

As shown in FIG. 35, in each of the evacuating carts 11, the coil heaters of the sealing jigs 26A, 26B are connected to the terminals $ES_{COM}$, ESL, ESR through a voltage converter having a voltage conversion ratio of 208:20, for example.

As shown in FIG. 35, each of the automatic sealing jig detecting devices 143, 144 comprises a power feeding device connected to a constant-voltage power supply 154 and having an automatic sealing jig detecting function.

Figure 36:
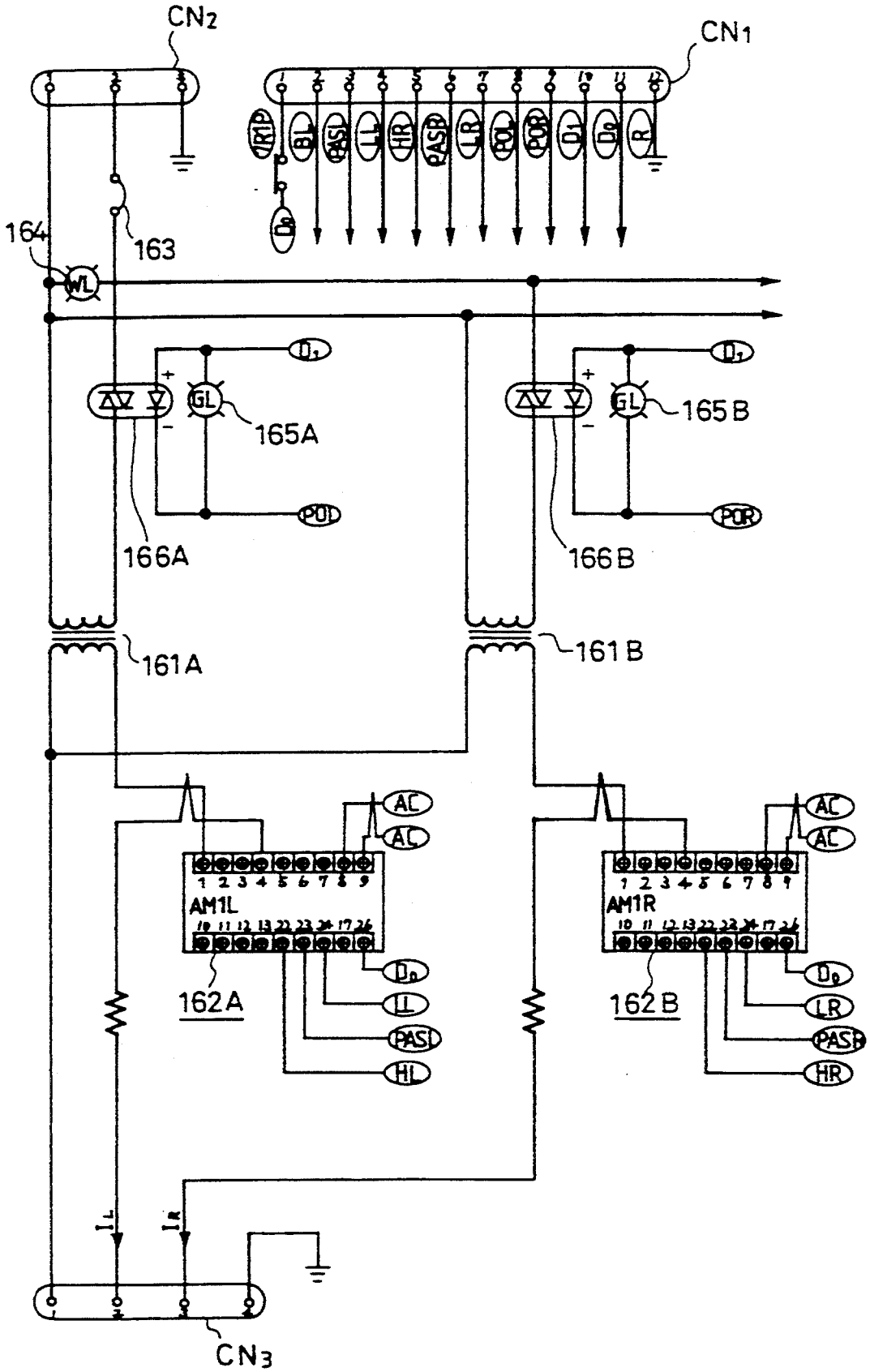
FIG. 36 is a circuit diagram of the automatic sealing jig detecting device.

FIG. 36 shows a circuit arrangement of each of the automatic sealing jig detecting devices. The automatic sealing jig detecting device has voltage converters, i.e., slidacs, 161A, 161B connected parallel to each other, in association with the respective sealing jigs 26A, 26B. The voltage converters 161A, 161B have respective primary windings connected to a connector $CN_2$ connected to the constant-voltage power supply 154, and respective secondary windings connected to a connector $CN_3$ connected to the sealing jigs 26A, 26B.

The secondary windings of the voltage converters 161A, 161B are connected at one terminal thereof to respective ammeters 162A, 162B, called linear sensor digital panel heaters, which have a display function.

The circuit arrangement also has AC terminals AC for supplying AC power to operate the ammeters 162A, 162B, common terminals $D_0$, and terminals LR, LL, PASR, PASL, HR, HL. A current value in excess of a lower limit of a preset range is detected at the terminals LR, LL. A current value falling in the preset range is detected at the terminals PASR, PASL. A current value in excess of an upper limit of the preset range is detected at the terminals HR, HL. These terminals are connected to the external controller of the apparatus.

The circuit arrangement further has a breaker 163, indicator lamps 164, 165A, 165B, relays 166A, 166B, and a connector $CN_1$.

When the coil heaters 152 suffer a short circuit or wire breakage, the currents flowing through the secondary windings of the voltage converters or slidacs 161A, 161B change. Therefore, when such current changes are detected by the ammeters 162A, 162B, a failure of the sealing jigs 26A, 26B and hence the evacuating cart 11, and also an abnormal condition of the cathode-ray tube bulbs sealed on the evacuating art 11 can be detected. Each of the automatic sealing jig detecting devices 143, 144 can also detect a short circuit across one turn of the coil heater 152. Such failure or abnormal-condition information is written in a data carrier 68 (see FIG. 7) which is provided on each of the evacuating carts 11 for reading and writing information. Based on the information stored in the data carrier 168, a malfunctioning evacuating cart 11 can be replaced with a normal one.

If the coil heater 152 of each sealing jig 26 has seven coil turns, a minimum change occurs in the coil resistance due to a short circuit across one turn. If it is assumed that the sealing jig 26 comprises a uniform resistive body, the minimum resistance change $A_{min}$ is expressed by:

$$\begin{aligned} A_{min} &= 0.478\ (\Omega)/8 \\ &= 0.05975\ (\Omega). \end{aligned}$$

The reasons why the minimum resistance change $A_{min}$ can be detected by the automatic sealing jig detecting devices 143, 144 will be described below.

A resistance $B_{min}$ of the sealing jig when it suffers a minimum resistance change, a resistance $B_{max}$ thereof when it is fully short-circuited, and a resistance $B_{opn}$ thereof when it suffers a wire break are given as follows:

$$\begin{aligned} B_{min} &= 0.478\ (\Omega) - 0.05975\ (\Omega) \\ &= 0.41825\ (\Omega), \\ B_{max} &= 0\ (\Omega), \text{ and} \\ B_{opn} &= \infty\ (\Omega). \end{aligned}$$

It is now assumed that a normal sealing jig is indicated by $G_{OK}$, a sealing jig suffering a short circuit across one coil turn by $G_{mi}$, a fully short-circuited sealing jig by $G_{max}$, and a sealing jig suffering a wire break by $G_{opn}$.

The secondary winding resistances $C_{OK}$, $C_{min}$, $C_{max}$, $C_{opn}$, as viewed from each of voltage converters 169A, 169B (indicated by 169), of the sealing jigs $G_{OK}$, $G_{min}$, $G_{max}$, $G_{opn}$ are given as follows:

$$\begin{aligned} C_{OK} &= 0.5\ (\Omega), \\ C_{min} &= 0.5\ (\Omega) - 0.05975\ (\Omega) \\ &= 0.44025\ (\Omega), \\ C_{max} &= 0 \sim 0.15\ (\Omega), \text{ and} \\ C_{opn} &= \infty\ (\Omega). \end{aligned}$$

The variable resistor 153 can be adjusted in a range of from 0 to 0.15 (Ω), so that the sum of the resistances of the sealing jig 26 and the variable resistor 153 can be adjusted to 0.5 (Ω).

The impedances $D_{OK}$, $D_{min}$, $D_{max}$, $D_{opn}$, as viewed from the automatic sealing jig detecting devices 143, 144 through the voltage converter 169 having a voltage conversion ratio of 208:20, of the sealing jigs $G_{OK}$, $G_{min}$, $G_{max}$, $G_{opn}$ are given as follows:

$$\begin{aligned} D_{OK} &= 0.5\ (\Omega) \times (208/20)^2 \\ &= 54.08\ (\Omega), \\ D_{min} &= 0.44025\ (\Omega) \times (208/20)^2 \\ &= 47.62\ (\Omega), \\ D_{max} &= 0 \sim 0.15\ (\Omega) \times (208/20)^2 \\ &= 0 \sim 16.22\ (\Omega), \text{ and} \\ D_{opn} &= \infty\ (\Omega). \end{aligned}$$

Each of the ammeters 162A, 162B has the following primary specifications:

Power supply voltage: AC 100 ~240 V
Input type: AC
Input range: 00.00 ~10.00 (A)
Accuracy: +0.1 %
Others: Comparison with a current setting may be made, and the result may be transmitted automatically as a transistor output to an external source.

Currents are detected using the ammeters 162A, 162 B. Currents $I_{OK}$, $I_{min}$, $I_{max}$, $I_{opn}$ flowing into the ammeters 162 A, 162B connected to the sealing jigs $G_{OK}$, $G_{min}$, $G_{max}$, $G_{opn}$ are as follows:

$$\begin{aligned} I_{OK} &= 6\ (V)/(54.08\ (\Omega) + 1\ (\Omega)) \\ &\approx 0.109\ (A), \\ I_{min} &= 6\ (V)/(46.62\ (\Omega) + 1\ (\Omega)) \\ &\approx 0.123\ (A), \\ I_{max} &= 6\ (V)/(0 \sim 16.22\ (\Omega) + 1\ (\Omega)) \\ &\approx 6 \sim 0.348\ (A), \text{ and} \\ I_{opn} &= 6\ (V)/\infty\ (\Omega) = 0\ (A). \end{aligned}$$

A minimum current change $\Delta I$ produced by the sealing jigs 26A, 26B is:

$$\Delta I = I_{min} - I_{OK} = 0.014\ (A).$$

Figure 37:
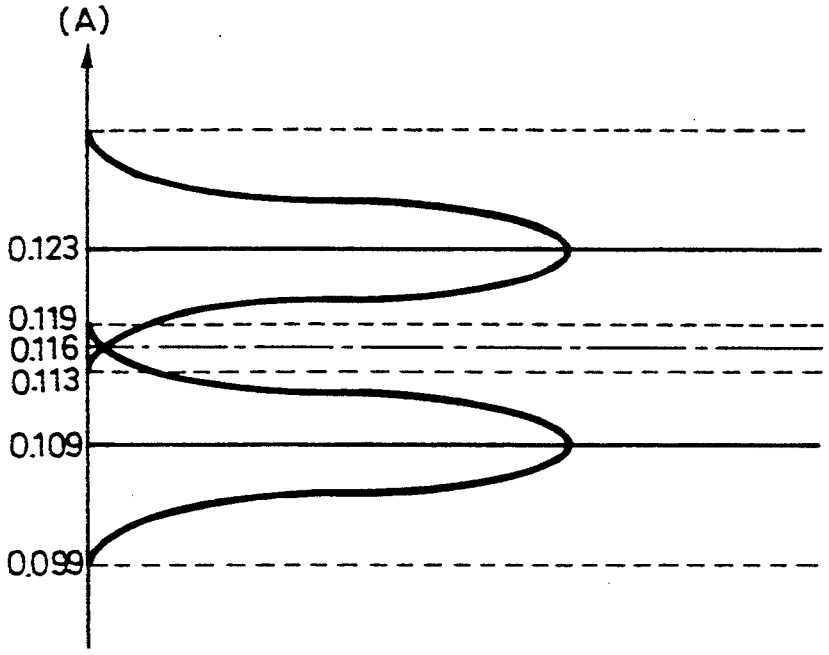
FIG. 37 is a graph illustrative of an operation of the apparatus.

Considering the accuracy of the ammeters 162A, 162B, i.e. , $$10.00(A) \times \pm 0.1\% = \pm 0.01(A),$$

and also FIG. 37, it is possible to automatically detect a sealing jig failure due to a short circuit across one turn of the coil heater 152, with a probability considerably higher than 80%, and also to automatically detect reliably a sealing jig failure due to a wire break of the coil heater 152 or a short circuit across two or more turns of the coil heater 152.

A current of 6 (A) flows into each of the ammeters 162A, 162B connected to a fully short-circuited sealing jig. Since this current value falls within the input range of the ammeters, no damage is caused to the ammeters when such a current flows in, and hence no problem arises with respect to the circuit protection of the automatic sealing jig detecting devices 143, 144.

FIG. 37 will be described below. If a comparison setting for the ammeters is 0.119 (A) , then, provided variations are uniform, the probability that a sealing jig with a short circuit across one turn of the coil heater 152 is erroneously determined as a good sealing jig is, $$(0.119-0.113)/(0.133-0.113)=30\%.$$

If a comparison setting for the ammeters is 0.116 (A), then, provided variations are uniform, the probability that a sealing jig with a short circuit across one turn of the coil heater 152 is erroneously determined as a good sealing jig and the probability that a good sealing jig is erroneously determined as a poor sealing jig is, $$(0.116-0.113)/(0.133-0.113)=15\%,$$

$$(0.119-0.116)/(0.119-0.099)=15\%,$$

$$15\%+15\%=30\%.$$

If a comparison setting for the ammeters is 0.113 (A) , then, provided variations are uniform, the probability that a good sealing jig is erroneously determined as a poor sealing jig is, $$(0.119-0.113)/(0.119-0.099)=30\%.$$

Since the variations are approximated by a normal distribution, as shown in FIG. 37, if 0.116 is used as a comparison setting when an overlapping area is minimum, then it is possible to determine a sealing jig failure with a probability of at least:

$$100-30=70\%.$$

Operation of the apparatus for manufacturing cathode-ray tubes according to the present invention will be described below.

In the position [8], the lid 33 of the protective cover 34 of an evacuating cart 11 is opened. Then, the evacuating cart 11 is moved to the position [9] in which cathode-ray tube bulbs 1 are automatically transferred onto the evacuating cart 11 by the automatic cathode-ray tube bulb charging device 14.

Then, in the position [14], the cathode-ray tube bulb centering device 15 is operated to cause the chucks 44A, 44B, 45A, 45B, 46A, 46B to position the evacuating pipes 4 of the cathode-ray tube bulbs 1 into alignment with the evacuating ports 24A, 24B. The cathode-ray tube bulbs 1 are lowered together with the holders 35 to insert the evacuating pipes 4 through the sealing jigs 26A, 26B into the respective evacuating ports 24A, 24B.

Then, in the position [16], the lid 33 is automatically closed, and the port rubber seal rings 112 of the evacuating ports 24A, 24B are automatically tightened by the evacuating port tightening device 16 for thereby preventing vacuum leakage through the evacuating ports 24A, 24B.

Thereafter, the evacuating cart 11 is delivered into the evacuating furnace 13. In the position [18], the limit switches 122, 123, 125, 126 are actuated by the limit switch actuator 130 for thereby turning on the oil rotation pump and the oil dispersion pump and also turning on the sealing jigs 26A, 26B. Subsequently, the evacuating cart 11 is conveyed in the evacuating furnace 13 in which the cathode-ray tube bulbs 1 are evacuated. In the position [161], the vacuum in the cathode-ray tube bulbs 1 is measured by the vacuum measuring device 145.

If a predetermined vacuum is not achieved in the cathode-ray tube bulbs 1, then the sealing jigs are turned off in a subsequent sealing process based on the information from the vacuum measuring device 145, and the cathode-ray tube bulbs 1 will not be sealed.

If a predetermined vacuum is achieved in the cathode-ray tube bulbs 1, then the cathode-ray tube bulbs 1 will be sealed in the sealing process.

In the position [163] preceding the sealing process, the coil heaters 152 of the sealing jigs 26A, 26B are checked by the automatic sealing jig detecting devices 143, 144. The information representing the checked status of the coil heaters 152 is recorded in the data carrier 168 of the evacuating cart 11.

Then, while the evacuating cart 11 is moving through the positions [164]~[191], the evacuating pipes 4 are sealed according to temperature distributions based on the electric power supplied by the sealing power feeding devices $ES_1 \sim ES_{28}$. In the position [178], the limit switch 123 is actuated by the limit switch actuator 130 to turn off the oil dispersion pump.

In the position [192] following the sealing process, the coil heaters 152 of the sealing jigs 26A, 26B are checked again by the automatic sealing jig detecting devices 143, 144. The information representing the checked status of the coil heaters 152 is recorded in the data carrier 168 of the evacuating cart 11.

In the position [199], the limit switches 122, 124 are actuated by the limit switch actuator 130 thereby to turn off the oil rotation pump and open the air opening for both the pumps, so that the pressure in the oil rotation pump and the oil dispersion pump will gradually return to the atmospheric pressure.

When the evacuating cart 11 leaves the evacuating furnace 13, the limit switch 124 is actuated by the limit switch actuator 130 to close the air opening. In the position [1] outside of the evacuating furnace 13, the port rubber seal rings 112 of the evacuating ports 24A, 24B are loosened by the evacuating port loosening device 17.

In the position [2], the lid 33 of the protective cover 34 is opened. The sealed cathode-ray tube bulbs 1 are lifted with the holders 35.

In the position [3], the evacuating pipe detecting device 18 is operated to confirm whether the evacuating pipes 4 are damaged or not. If not damaged, then the sealed cathode-ray tube bulbs 1 are automatically removed from the evacuating cart 11 by the automatic cathode-ray tube bulb removing device 19 in the position [4], and transferred to a next process. If the evacuating pipes 4 are damaged and remain in the evacuating ports 24A, 24B, then the evacuating cart 11 is discharged from the apparatus at the position [6], and a replacement evacuating cart 11 is charged into the apparatus at the position [7 ].

If no cathode-ray tube bulbs are supplied to an evacuating cart 11 at the first position [9], then dummy evacuating pipes on the evacuating cart 11 are inserted into the evacuating ports 24A, 24B by the dummy evacuating pipe inserting device 22A. In the position [16], the port rubber seal rings 112 of the evacuating ports 24A, 24B are tightened by the evacuating port tightening device 16.

The evacuating cart 11 then travels through the evacuating furnace 13. In the position [1] outside of the evacuating furnace 13, the port rubber seal rings 112 of the evacuating ports 24A, 24B are loosened. Thereafter, when the evacuating cart 11 is moved to the position [2], the dummy evacuating pipes 36 are removed from the evacuating ports 24 by the dummy evacuating pipe removing device 22B, and stored on the storage members 37A, 37B on the evacuating cart 11.

Since the apparatus has the automatic devices 15, 16, 17, 18, 19, 141, 142, it can automatically evacuate and seal cathode-ray tube bulbs with increased reliability.

In particular, the cathode-ray tube bulb centering device 15 can automatically position accurately a cathode-ray tube bulb 1 which has roughly been placed on an evacuating cart 11 by the automatic cathode-ray tube bulb charging device 14. Therefore, the evacuating pipe 4 of the positioned cathode-ray tube bulb 1 can easily and reliably be inserted into a corresponding evacuating port.

Each of the dummy evacuating pipe inserting-/removing devices 22A, 22B can automatically insert a dummy evacuating pipe 36 into an evacuating port on an evacuating cart 11 onto which a cathode-ray tube bulb 1 has not been charged. Because of the dummy evacuating pipe 36, the evacuating cart 11 can be subjected to vacuum aging. Therefore, the evacuating cart 11 is prevented from malfunctioning due to a reverse flow of oil from a vacuum pump which would otherwise be caused by an oversight on the part of the worker to insert a dummy evacuating pipe 36.

Subsequently, the inserted dummy evacuating pipe 36 can automatically be removed from the evacuating cart 11. Accordingly, a secondary accident which would otherwise be caused by charging a cathode-ray tube bulb 1 onto the evacuating cart 11 with the dummy evacuating pipe 36 left thereon is prevented from occurring.

The evacuating pipe detecting device 18 can automatically detect even a short circuit across one turn of the coil heaters. Therefore, it is possible to automatically detect, at an early time, a failure which may happen when the evacuating pipe 4 of a cathode-ray tube bulb 1 is sealed, and to automatically determine the prevention of such a failure from happening again.

Since a failure of the sealing jigs 26A, 26B can be detected with higher accuracy than heretofore, the production of cathode-ray tubes based on less accurate worker judgment can be avoided.

If the switch actuating bar 131 of the limit switch actuator 30 is engaged by the rotatable shaft 127 of each of the limit switches 122 ~126 for some reason, then the switch actuating bar 131 is turned 90° about the shafts 134, 138 by the rotatable shaft 127, thus retracting the rod 137 of the air cylinder 136. The sensor 139 can detect such an abnormal condition. Accordingly, such an accident can be detected early, and the apparatus may automatically be brought into an optimum condition based on the detected information. It is thus possible to avoid inaccurate worker judgment and operations with low reliability.

The evacuating pipe detecting device 18 can detect whether the evacuating pipe 4 of a sealed cathode-ray tube bulb 1 is damaged or not. If the evacuating pipe 4 is broken, then the evacuating cart 11 carrying such a sealed cath-ode-ray tube bulb 1 is discharged, and a new evacuating cart 11 is charged into the apparatus. Consequently, a secondary accident which would otherwise be caused by charging a cathode-ray tube bulb 1 onto the evacuating cart 11 with the dummy evacuating pipe 36 left thereon is prevented from occurring.

Having described a preferred embodiment of the invention with reference to the accompanying drawings, it is to be understood that the invention is not limited to that precise embodiment and that various changes and modifications could be effected by one skilled in the art without departing from the spirit or scope of the invention as defined in the appended claims.

What is claimed is:

1. An apparatus for manufacturing a cathode-ray tube by evacuating a cathode-ray tube bulb and sealing an evacuating pipe of the cathode-ray tube bulb, comprising:

an evacuating furnace;

a plurality of evacuating units for carrying respective cathode-ray tube bulbs thereon, and evacuating and sealing the respective cathode-ray tube bulbs;

means for feeding said evacuating units circulatingly along a feed path into and out of said evacuating furnace; and an evacuating pipe detecting device disposed at a position along said feed path for detecting whether the evacuating pipe of the cathode-ray tube bulb carried on each of aid evacuating units is damaged or not.

2. An apparatus according to claim 1, further comprising:

means for discharging, out of said feed path, an evacuating unit on which the evacuating pipe is detected by said evacuating pipe detecting device as being damaged and does remain.

3. An apparatus according to claim 1, wherein each of said evacuating units has a switch, further comprising:

a switch actuator for actuating the switch of each of said evacuating units;

said switch actuator comprising an actuating member for actuating said switch, an air cylinder having a piston rod, and a fixed member, said actuating member having an end angularly movably supported on said fixed member, said actuating member having a side extension angularly movably supported on a distal end of said rod, the arrangement being such that when at least a predetermined force is applied to said actuating member, said actuator member is moved retracting said rod.

4. An apparatus according to claim 1, wherein said evacuating pipe detecting device comprises:

photoelectric sensor means having a light-emitting element and a light-detecting element which are disposed in spaced confronting relationship to each other; and control means for reciprocally moving said photoelectric sensor means so as to allow the evacuating pipe of the cathode-ray tube carried on each of said evacuating units to pass between said light-emitting element and said light-detecting element.

5. An apparatus according to claim 4, wherein said control means comprises means for moving said photoelectric sensor means toward the evacuating pipe at a speed higher than a speed at which said photoelectric sensor means moves away from the evacuating pipe.

6. An apparatus according to claim 1, further comprising:

dummy evacuating pipe insert/removing means for inserting a dummy evacuating pipe into and removing a dummy evacuating pipe from an evacuating unit on which a cathode-ray tube bulb is not carried.

7. An apparatus according to claim 6, wherein each of said evacuating units has an evacuating port for evacuating the cathode-ray tube bulb carried thereon, said dummy evacuating pipe insert/removing means comprising:

a floating mechanism;

a movable base movable by said floating mechanism;

a first chuck assembly for holding and transferring a dummy evacuating pipe onto said movable base; and a second chuck assembly for holding a reference member to assure a predetermined positional relationship with respect to an evacuating port of each of said evacuating units.

8. An apparatus according to claim 1, wherein each of said evacuating units has a sealing jig for sealing the evacuating pipe of a cathode-ray tube bulb carried thereon, further comprising:

sealing jig detecting means for detecting a failure of the sealing jig of each of said evacuating units.

9. An apparatus according to claim 8, wherein said sealing jig detecting means comprises:

a terminal assembly for contacting an external terminal of the sealing jig of each of said evacuating units;

a constant-voltage power supply for supplying a constant voltage to said terminal assembly; and an ammeter connected to a current path of said terminal assembly for detecting a current change in said current path depending on a failure of the sealing jig.

* * * * *